US006603452B1

(12) United States Patent
Serita

(10) Patent No.: US 6,603,452 B1
(45) Date of Patent: Aug. 5, 2003

(54) COLOR SHADING CORRECTION DEVICE AND LUMINANCE SHADING CORRECTION DEVICE

(75) Inventor: Hiroaki Serita, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/495,290

(22) Filed: Feb. 1, 2000

(30) Foreign Application Priority Data

Feb. 1, 1999 (JP) ..... 11-024029
Feb. 1, 1999 (JP) ..... 11-024030

(51) Int. Cl.[7] ..... G09G 3/36

(52) U.S. Cl. ..... 345/88; 345/211; 345/213; 345/103; 345/589; 345/903; 345/92; 348/223; 348/251; 348/241; 348/243; 348/247; 348/250; 348/687; 348/712

(58) Field of Search ..... 345/88, 211, 213, 345/87, 92, 103, 903, 589; 348/251, 223, 246, 243, 247, 241, 250, 687, 712

(56) References Cited

U.S. PATENT DOCUMENTS 4,825,201 A * 4/1989 Watanabe et al. ..... 340/717
5,526,058 A * 6/1996 Sano et al. ..... 327/350
5,801,785 A * 9/1998 Crump et al. ..... 348/563
5,838,396 A * 11/1998 Shiota et al. ..... 348/745
5,886,750 A * 3/1999 Osuga et al. ..... 348/615
6,072,527 A * 6/2000 Iwai ..... 348/243
6,181,830 B1 * 6/2001 Sato ..... 382/274

FOREIGN PATENT DOCUMENTS

JP 08-179727 7/1996
JP 10-84551 3/1998

* cited by examiner

*Primary Examiner*—Richard Hjerpe
*Assistant Examiner*—Ali Zamani
(74) *Attorney, Agent, or Firm*—Pillsbury Winthrop LLP

(57) ABSTRACT

A correction circuit 50 is provided to correct the luminance shading caused by uneven thickness of the liquid crystal layer in the LCD panel. The correction circuit 50 generates a correction signal obtained by modulating the gradually changing signal with smaller amplitude at positions closer to the center in the horizontal direction of the LCD panel and with smaller amplitude at positions closer to the center in the vertical direction when the signal is seen vertically. The signal in the lowfrequency range components of the video signal is used for such modulation. After addind the correction signal from the correction circuit 50 to the video signal by the adder 51, the signal is processed for AC driving and then supplied to the LCD panel section 10. By thus superimposing the correction signal on the video signal for the LCD panel, the luminance shading can be corrected. In particular, by correcting the luminance shadings on the LCD panels in the three-panel type unit so as to achieve the same pattern and brightness characteristics, color shading generation can be suppressed.

14 Claims, 16 Drawing Sheets

GAIN CONTROL

PHASE CONTROL 2V
0V
T1

T2

0

N
N

RISE OF PHASE CONTROL VOLTAGE V1

0

N
N

0
DECLINE OF PHASE CONTROL VOLTAGE V1

N
N

FIG. 8C-4
FIG. 8D-4
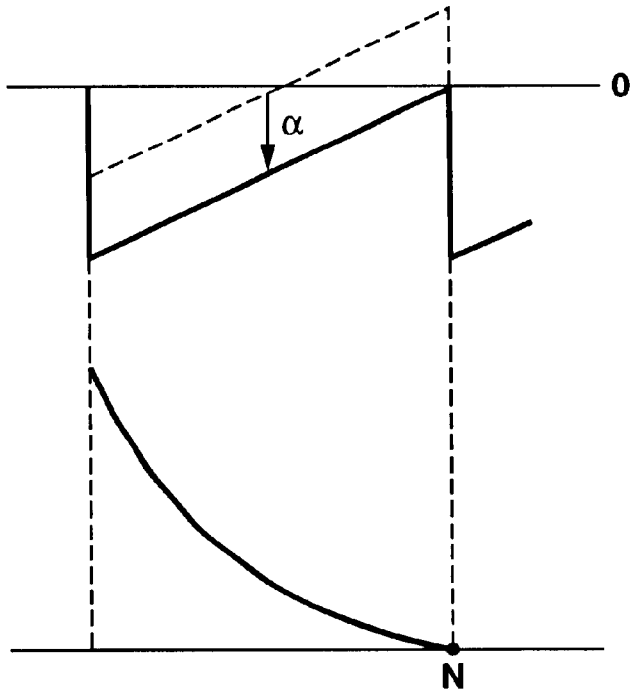
FIG. 8C-5
FIG. 8D-5
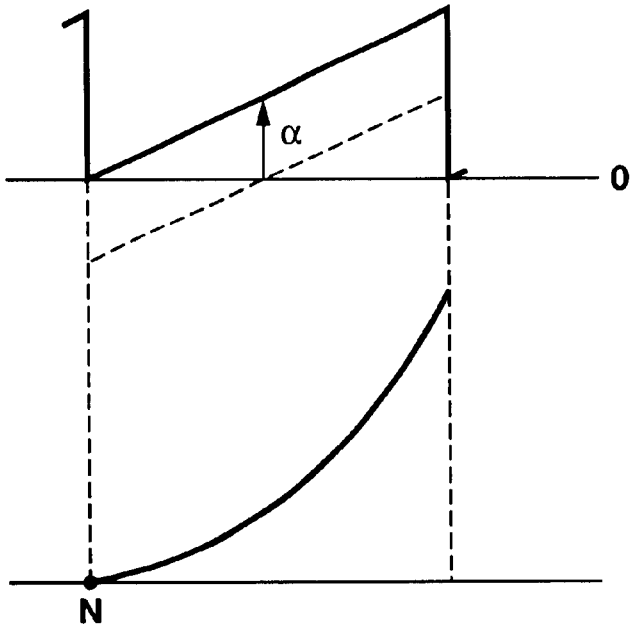

INVERTING AMPLIFIER $Q_1$

NON-INVERTING AMPLIFIER $Q_2$

VIDEO SIGNAL

CORRECTION SIGNAL

OUTPUT FROM ADDER 51

OUTPUT FROM INVERTING AMPLIFIER $Q_1$
15V
CENTER VOLTAGE OF VIDEO SIGNAL (7.5V)
OUTPUT FROM NON-INVERTING AMPLIFIER $Q_2$
0V

ALTERNATING PULSE $f_H$

OUTPUT FROM ALTERNATION CIRCUIT 13
CENTER VOLTAGE OF VIDEO SIGNAL
1 HORIZONTAL PERIOD

GLASS SUBSTRATE
LIQUID CRYSTAL
GLASS SUBSTRATE

SCREEN
LUMINANCE SHADING

HAW TO PRODUCE CORRECTION SIGNAL
VERTICAL DIRECTION
HORIZONTAL DIRECTION

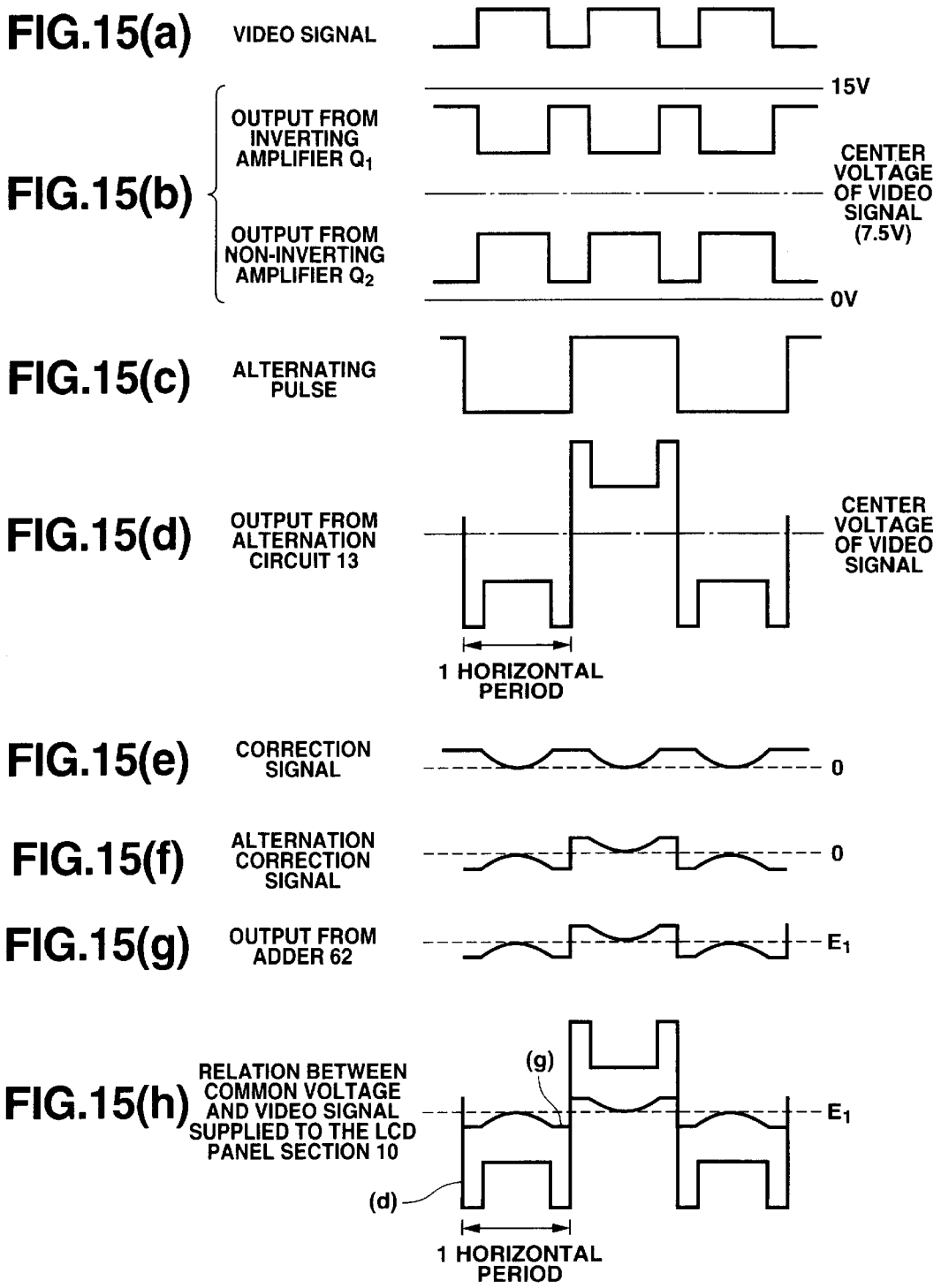
FIG.15(a)
VIDEO SIGNAL
15V
FIG.15(b)
OUTPUT FROM INVERTING AMPLIFIER $Q_1$
CENTER VOLTAGE OF VIDEO SIGNAL (7.5V)
OUTPUT FROM NON-INVERTING AMPLIFIER $Q_2$
0V
FIG.15(c)
ALTERNATING PULSE
FIG.15(d)
OUTPUT FROM ALTERNATION CIRCUIT 13
CENTER VOLTAGE OF VIDEO SIGNAL
1 HORIZONTAL PERIOD
FIG.15(e)
CORRECTION SIGNAL
0
FIG.15(f)
ALTERNATION CORRECTION SIGNAL
0
FIG.15(g)
OUTPUT FROM ADDER 62
$E_1$
FIG.15(h)
RELATION BETWEEN COMMON VOLTAGE AND VIDEO SIGNAL SUPPLIED TO THE LCD PANEL SECTION 10
(g)
$E_1$
(d)
1 HORIZONTAL PERIOD

LCD PANEL B

LCD PANEL R

COLOR SHADING CORRECTION DEVICE AND LUMINANCE SHADING CORRECTION DEVICE

BACKGROUND OF THE INVENTION

1. Field of the Invention

The present invention relates to a color shading correction device and a luminance shading correction device installed in a three-panel type or other multi-panel type LCD projector or a single-panel type LCD projector and, in particular, to a color shading correction device and a luminance shading correction device which can correct the luminance shading caused by uneven thickness of the liquid crystal layer (uneven gap) of the LCD panel and can correct the color shading caused by the luminance shading pattern on the LCD panels.

2. Description of the Related Art

Display devices using LCD screens are diffused recently. For example, pocket-type LCD TV sets, display units for laptop type computers and LCD projectors are in the market.

In particular, in response to the request for a compact and light-weight display unit with a large screen, LCD projectors using LCD panels are developed popularly. Since the LCD projector system can be provided with a large screen easily, it is expected to be used with the high definition TV. It is well known that the LCD projector uses LCD panels as light bulbs and displays the picture by irradiating the light from the light source and changing the transmission rate of the LCD panels in response to the video signal and displays the enlarged image of such picture on the screen using the optical system including the projection lens.

LCD projectors can be classified into the single-panel type using a single LCD panel and the three-panel type using three LCD panels. Single-panel type can be structured easily and at a low cost. However, when a color filter is adopted in a single-panel type for color display, the resolution tends to decline. This is why the three-panel type is often used. A three-panel type LCD projector uses three monochrome LCD panels of active matrix type, etc., having a switching device such as a thin film transistor (TFT) for each pixel.

The three-panel type LCD projector uses three LCD panels and once decomposes the light from the light source into three primary colors R (Red), G (Green) and B (Blue), which are respectively input to each of the LCD panels. Then, it synthesizes the three primary color lights after passing through each of the applicable LCD panels again so as to display the color picture.

Recently, the LCD data projector is drawing attention as a presentation tool used with a PC (Personal Computer). Considering the need of adaptation to various utilization environment, the three-panel structure as described above enabling bright screen and high resolution is suitable for such an LCD data projector.

Usually, the LCD panel used in the above LCD data projector uses an LCD driving circuit which amplifies the voltage of the input video signal to a necessary level and executes AC driving for a longer service life of the LCD.

FIG. 16 is a block diagram to illustrate an example of an LCD driving circuit used in such conventional three-panel type LCD data projector.

As shown in FIG. 16, an LCD data projector is, for example, provided with three active matrix type LCD panel sections 10, 20 and 30. Each of the LCD panel sections 10, 20 and 30 comprises an LCD panel, a horizontal driving section (a sample/hold circuit and a horizontal driver circuit) and a vertical driving section (a vertical driver circuit) respectively.

The LCD panel section 10 forms the red (R) image, the LCD panel section 20 forms the green (G) image and the LCD panel section 30 forms the blue (B) image. R video signal (R signal) is supplied via an input terminal 11, a video processing circuit 12 and an alternation circuit 13 to the LCD panel section 10, G video signal (G signal) is supplied via an input terminal 21, a video processing circuit22 and an alternation circuit 23 to the LCD panel section 20 and B color video signal (B signal) is supplied via an input terminal 31, a video processing circuit 32 and an alternation circuit 33 to the LCD panel section 30. The clock pulse and various timing pulses required for displaying the color video signals are supplied from a timing circuit 40.

The video processing circuits 12, 22 and 32 are for clamping, amplification, and gamma correction of the input video signals R, G and B. The alternation circuits 13, 23 and 33 reverse the polarity of the video signals R, G and B for every predetermined period or one line (i.e. one horizontal period), for example, with AC and DC voltages of the signal in order for AC driving of the LCD. This AC driving is executed for a longer service life of the LCD panel. This takes advantage of the theory that the transmission rate of the LCD panel is determined by the voltage difference between the common voltage E1, E2 or E3 and the video signal voltage of each color regardless of the video signal polarity for the common voltage. In other words, for the video signal of each color, the polarity is reversed around the DC level (Common voltage) E1, E2 or E3 at the pixel common electrodes (common terminals) 10*a*, 20*a* and 30*a* of the LCD panel kept at +7.5 V, for example, with reference to 0V on the substrate. Thus, change in the average DC level caused by each color video signal on each LCD panel is canceled so that the LCD is always driven at a certain DC level and can be used for a longer service life. The timing circuit 40 generates from the horizontal (H) and vertical (V) sync signals input from the input terminal 41, the alternating pulse fH for the alternation circuits 13, 23 and 33 and the timing signal to drive the LCD panel sections 10, 20 and 30.

The LCD panel has a structure as shown in FIG. 17 and is provided with liquid crystal 100 enclosed between two glass substrates 101 and 102. In a plan view, it has a structure as shown in FIG. 18. It comprises pixels constituted by the liquid crystal, a thin film transistor (TFT) such as a field effect transistor (FET) provided for each pixel, a source line to supply the pixel signal sampled and held from the horizontal driving section to the source of the TFT, and a gate line to supply the scanning signal from the vertical driving section to the gate of the TFT.

In the liquid crystal structure as shown in FIG. 17, uneven thickness of the liquid crystal layer results in luminance shading. Referring to FIGS. 19 to 21, how the luminance shading is generated is described below.

FIG. 19 shows the change in brightness of the liquid crystal layer when the input voltage changes up to the common voltage as the maximum value with the horizontal axis representing the input voltage and the vertical axis representing the brightness (luminance) and with taking the input voltage at the vertical axis as the common voltage. This figure shows the normally black liquid crystal and the closer the input voltage is to the common voltage, the brighter the brightness becomes and the further it becomes from the common voltage, the brightness becomes darker. When the input voltage is close to the common voltage, the brightness becomes saturated (Brightness: 100%). Even with the same input voltage supplied to the source line, the brightness varies depending on the liquid crystal layer thickness. When the liquid crystal layer is thicker, the brightness becomes brighter and when the liquid crystal layer is thinner, the brightness becomes darker. This is called the luminance shading caused by uneven gap.

Further, in case of the three-panel type projector, any difference in pattern or position of the luminance shading generated on each of the LCD panels R, G and B may cause color shading in the synthesized color image. FIG. 20(*a*) shows an example of the luminance shading on the LCD panel B which has brighter brightness at positions closer to the center of the screen and becomes darker at positions closer to the periphery in both of the horizontal and vertical directions. This is a typical generation pattern of luminance shading. On the other hand, FIG. 20(*b*) shows an example of the luminance shading on the LCD panel R. The brightest area is displaced from around the center of the panel in both of the horizontal and vertical directions and the areas becoming darker at the periphery are also displaced.

Such difference in the generation pattern of the luminance shadings on the two LCD panels results in color shading in the synthesized color image projected via a dichroic mirror and a projection lens. This means that the color image according to the input signal cannot be reproduced correctly. Therefore, it is essential to eliminate the luminance shading on the LCD panels or to approximate the generation pattern of the luminance shading on the LCD panels to prevent color shading.

Generally used for minimization of such luminance shading are spherical-shaped pillars having a diameter which is the same as the thickness of the liquid crystal (referred to as the pearl beads). They are mixed with the liquid crystal so as to maintain a certain thickness for the liquid crystal layer. However, there is a drawback about the pearl beads. Since they are not positioned selectively, they are sometimes located on pixels and their existence can be seen. In case of a small size LCD panel, in particular, the size of one pixel (electrode) is about 20 $\mu$m×20 $\mu$m and the pearl bead has a diameter of about 5 $\mu$m. Because the pearl bead is too large for the pixel (electrode), the pearl beads have to be omitted. This results in difference in the thickness of the crystal liquid layer between the peripheral section and the central section of the LCD panel and, as shown in FIG. 21, sections near the panel center tend to project (or recess) and provide the luminance shading with brighter (or darker) luminance at positions closer to the center of the screen.

Further, in case of the three-panel type projector, luminance shading may, though its generation is prevented on any LCD panel, be generated on other LCD panel or the luminance shading may be generated differently on the different LCD panels and such luminance shadings appear as color shadings in the synthesized color image of projection.

Thus, in case of the compact LCD panel for which the pearl beads have to be omitted, the luminance shading is generated due to structural deformation of the LCD panel. In case of the three-panel type, in particular, difference in the luminance shading pattern generated on the different LCD panels may cause color shading on the synthesized color image.

SUMMARY OF THE INVENTION

It is an object of the present invention to provide a color shading correction device and a luminance shading correction device which can suppress generation of the luminance shading caused by uneven thickness of the liquid crystal layer (uneven gap) in the LCD panel and which, even when the luminance shadings are generated differently on different LCD panels, can suppress generation of color shading.

A color shading correction device of a first invention is used in a liquid crystal display device which has a plurality of LCD panels, modulates the color lights coming into each of the LCD panels according to the video signals and synthesizes the modulated color lights. It comprises a timing circuit to generate the timing signal required for displaying the picture on said plurality of LCD panels, a plurality of signal processing circuits to input the video signals for modulating the color lights on said plurality of LCD panels, to process each of the video signals so as to supply them as the video signals suitable to each of said LCD panels, and a plurality of correction circuits to add the correction signals to any video signals supplied to said plurality of LCD panels so as to approximate the luminance shading characteristics caused on said plurality of LCD panels, in which each of said correction circuits includes a correction signal generating circuit to generate said correction signal for correcting the luminance shading and a circuit to change said correction signal in response to the level of the video signal before said addition so as to make the correction amount variable.

According to the first invention, by superimposing the correction signal on the video signal supplied to the LCD panel, the luminance shading characteristics of each of the LCD panels R, G and B are approximated and the correction amount changes in response to the level of the video signal supplied to the applicable LCD panel. This results in suppression of the color shading observed in the synthesized color image.

Each of said correction circuits in the color shading correction device of the first invention generates the gradually changing correction signal having smaller amplitude at positions closer to the center in the horizontal direction of the LCD panel and having smaller amplitude at positions closer to the center in the vertical direction or the gradually changing correction signal having larger amplitude at positions closer to the center in the horizontal direction of the LCD panel and having larger amplitude at positions closer to the center in the vertical direction and modulates this correction signal by the signal in the low frequency range components of the video signal.

In this manner, the correction signal suitable to the luminance shading pattern on each of the LCD panel can be generated by each of said correction circuits, achieving the color shading correction.

The correction signal generating circuit in a color shading correction device of the first invention also generates the parabolic correction signal, can change the level of the correction signal in reverse direction with reference to the vertex of this parabolic wave, and can change the amplitude of the correction signal in response to the luminance shading pattern on said LCD panel.

In this manner, the amplitude of the correction signal can be changed with reference to the vertex of the correction signal in response to the luminance shading pattern of the LCD panel.

The correction signal generating circuit in the color shading correction device of the first invention can change the phase of the vertex of the correction signal in response to the luminance shading pattern on the LCD panel.

The correction signal generating circuit can further adjust the phase of the correction signal by changing the DC voltage.

Thus, as the phase of the correction signal can be generated to be changeable in response to the luminance shading pattern on each of the LCD panels, the correction signal can be generated suitably to the position where the luminance shading is generated on the LCD panel. Moreover, the color shading correction processing can be executed easily because the phase of the correction signal can be adjusted simply by adjusting the DC voltage.

Further, each of said correction circuits in the color shading correction device of the first invention is provided for each of the plurality of LCD panels. These correction circuits generate the correction signals to approximate the luminance shading pattern generated on each LCD panel to a certain pattern as a reference for correction.

Since the luminance shading patterns generated on the LCD panels can be approximated to a certain pattern as the reference for correction with this feature, high definition synthesized color image can be obtained. For example, when bright areas are shifted from the center of the screen, the luminance shading pattern can be corrected to become the typical luminance shading pattern having the bright areas at the center of the screen. It is relatively easy to achieve generation of the correction signal for correction according to such a simple pattern.

In addition, each of said correction circuits in the color shading correction device of the first invention is provided for each of said LCD panels except for a first LCD panel and these correction circuits generate the correction signals to approximate the luminance shading patterns on said other LCD panels to the luminance shading pattern on the first LCD panel for correction.

With this feature, since the luminance shading patterns generated on said other LCD panels can be approximated to the luminance shading pattern on the first LCD panel, the color shading can be securely suppressed.

Further, the color shading correction device of the first invention executes, when the LCD panels are driven by the video signals with their polarities reversed for every predetermined period, addition of the correction signal from each of said correction circuits to each of the video signals before the signal processing to reverse the polarity of the video signals.

Consequently, even when the LCD panels are driven by the video signals with their polarities reversed for every predetermined period (for every horizontal period, for example), the correction signal from each of said correction circuits can be added properly, and the color shading correction can be achieved.

A color shading correction device according to a second invention is used in a liquid crystal display device having a plurality of LCD panels in which the color lights coming into each of the LCD panels are modulated according to the video signals and each of modulated color lights is synthesized. It comprises a timing circuit to generate a timing signal required for displaying a picture on said plurality of LCD panels, a plurarity of signal processing circuits to input the video signals for modulating the color lights on said plurality of LCD panels, to process each of the video signals so as to supply them as the video signals suitable to each of said LCD panels, a plurality of correction circuits to approximate the luminance shading characteristics caused on said plurality of LCD panels in which each of said correction circuits includes a correction signal generating circuit to generate said correction signal for correcting the luminance shading and a circuit to make the correction amount variable by changing said correction signal in response to the level of the video signal for the LCD panel for which the luminance shading is corrected, and a plurality of adding means to add said correction signals, to which said correction amount is adjusted, to the voltages supplied to the pixel common electrodes on each of said LCD panels where luminance shading corrections are performed.

Each of said correction circuits in a color shading correction device of the second invention is, when the LCD panels are driven by the video signals with their polarities reversed for every predetermined period, provided with a means to reverse the polarity of the correction signal for every predetermined period.

Thus, by superimposing the applicable correction signal on the common voltage supplied to the pixel common electrode on the LCD panels, the color shading can be corrected. Further, when the LCD panels are driven by the video signals with their polarities reversed for every predetermined period (for every horizontal period, for example), the correction circuit is provided with a means to reverse the polarity of the correction signal for every horizontal period and can achieve color shading correction similarly.

A luminance shading correction device according to a third invention comprises an LCD panel, a timing circuit to generate a timing signal required for displaying a picture on said LCD panels, a video signal input terminal, a signal processing circuit to process video signals inputted to said input terminal and to supply the video signals suitable to said LCD panels, and a correction circuit to approximate the luminance shading characteristics caused on said LCD panels by adding the correction signal to the video signal supplied to said LCD panels, including a correction signal generating circuit to generate said correction signal for correcting the luminance shading and a circuit to adjust the correction amount by changing said correction signal in response to the level of the video signal before receiving said addition.

In the third invention, the luminance shading can be corrected at a high precision by superimposing the correction signal on the video signal supplied to the LCD panel and further by changing the correction signal in response to the level of the video signal supplied to the LCD panel.

A luminance shading correction device according to a fourth invention comprises an LCD panel, a timing circuit to generate a timing signal required for displaying the picture on said LCD panels, a video signal input terminal, a signal processing circuit to process video signals inputted to said input terminal and to supply video signals suitable to said LCD panels, a correction circuit including a correction signal generating circuit to generate a correction signal for approximating the luminance shading characteristics caused on said LCD panel and a circuit to adjust the correction amount by changing said correction signal in response to the level of the video signal supplied to said LCD panel, and adding means to add said correction signal, to which the correction amount is adjusted, to the voltage supplied to the pixel common electrode on said LCD panel.

In the fourth invention, the luminance shading can be corrected at a high precision by superimposing the correction signal on the common voltage supplied to the pixel common electrode on the LCD panel and further by changing the correction signal in response to the level of the video signal supplied to the LCD panel.

The correction circuit in a luminance shading correction device in the third or fourth invention above further comprises a means to generate either the gradually changing correction signal having smaller amplitude at positions closer to the center in the horizontal direction of the LCD panel and having smaller amplitude at positions closer to the center in the vertical direction or the gradually changing correction signal having larger amplitude at positions closer to the center in the horizontal direction of the LCD panel and having larger amplitude at positions closer to the center in the vertical direction and a means to modulate the amplitude of the correction signal in response to the amplitude level of the video signal supplied to the LCD panel.

With this feature, when the thickness of the liquid crystal layer in the LCD panel is more projecting or recessing at positions closer to the center of the panel, for example, by generating the gradually changing correction signal which has smaller or larger amplitude at positions closer to the center of the LCD panel and further, changing the amplitude of such correction signal in response to the amplitude level of the video signal, the luminance shading on the LCD panel can be corrected at a higher precision.

The correction circuit in the luminance shading correction device of the third or fourth invention further comprises a first sawtooth wave generating circuit to which the horizontal sync signal is input and from which the sawtooth wave signal for one horizontal period is generated, a first parabolic wave generating circuit to which the sawtooth wave signal from the first sawtooth wave generating circuit is input and from which the parabolic wave signal for one horizontal period is generated, a second sawtooth wave generating circuit to which the vertical sync signal is input and from which the sawtooth wave signal for one vertical period is generated, a second parabolic wave generating circuit to which the sawtooth wave signal from the second sawtooth wave generating circuit is input and from which the parabolic wave signal for one vertical periodis generated, a first multiplier which multiplies the parabolic wave signal for one horizontal period from the first parabolic wave generating circuit and the parabolic wave signal for one vertical period from the second parabolic wave generating circuit so as to generate the correction signal for horizontal and vertical directions, a low pass filter to remove the high frequency range components from the input video signals, and a second multiplier which multiplies the correction signal from the first multiplier with the video signal from the low pass filter so as to modulate the amplitude of the correction signal in response to the amplitude level of the video signal.

Thus, for example, when the thickness of the liquid crystal layers are different, the brightness does not change in the same way as the change in the input voltage, but the brightness change characteristics change in response to the input voltage. Even in such case, by changing the correction amount of the correction signal in response to the height of the input voltage using the second multiplier serving as a gain control means (with increasing the correction amount for a high input voltage and decrease the correction amount for a low input voltage), the luminance shading can be corrected at a higher precision.

The luminance shading correction device of the third, or fourth invention executes, when the LCD panels are driven by the video signals with their polarities reversed for every predetermined period, addition of the correction signal to the video signals before the processing to reverse the polarity.

The correction circuit in the luminance shading correction device of the third, or fourth invention is, when the LCD panels are driven by the video signals with their polarities reversed for every predetermined period, provided with a means to reverse the polarity of the correction signal for every predetermined period.

With this feature, when the LCD panels are driven by the video signals with their polarities reversed for every predetermined period (for every horizontal period, for example), the polarity of the correction signal input to the LCD panel can be changed in response to the polarity of the video signal input to the LCD panel. Thus, the correction processing can be executed normally even in the LCD panel of the polarity reversing driving type.

BRIEF DESCRIPTION OF THE DRAWINGS

FIGS. 7(*a*), (*b*), (*c*1), (*d*1), (*c*2), (*d*2), (*c*3) and (*d*3) are waveform diagrams illustrating the phase control of the correction signal;

FIGS. 8(*c*4), (*d*4), (*c*5) and (*d*5) are waveform diagrams illustrating the phase control of the correction signal;

FIG. 15 is a waveform diagram illustrating the operations of the devices in FIG. 13;

DETAILED DESCRIPTION OF THE PREFERRED EMBODIMENTS

Referring to the attached figures, preferred embodiments of the present invention are described below.

Figure 1:
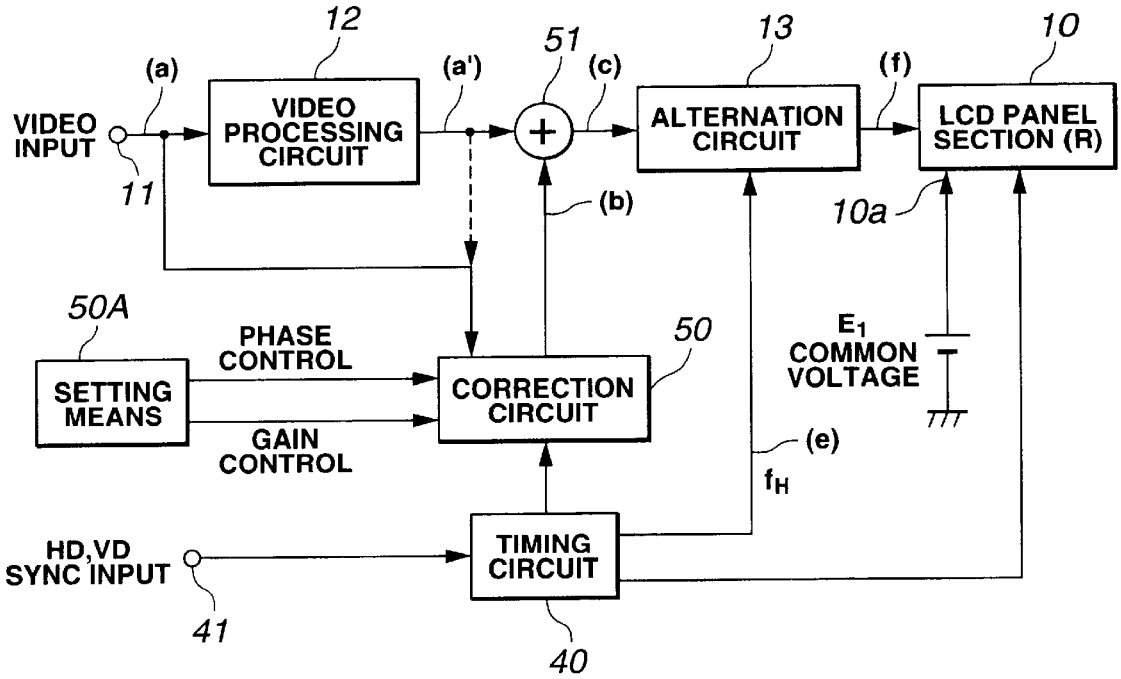
FIG. 1 is a block diagram illustrating a color shading correction device for the LCD panel according to an embodiment of the present invention.
Figure 2A:
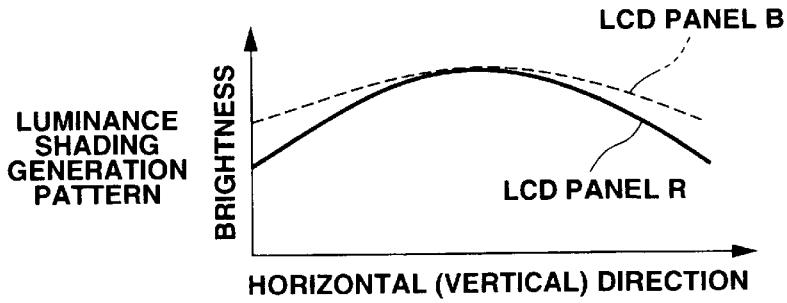
FIGS. 2(*a*) and (*b*) are explanatory views to illustrate the concept of the gain control for the color shading correction device in FIG. 1.
Figure 2B:
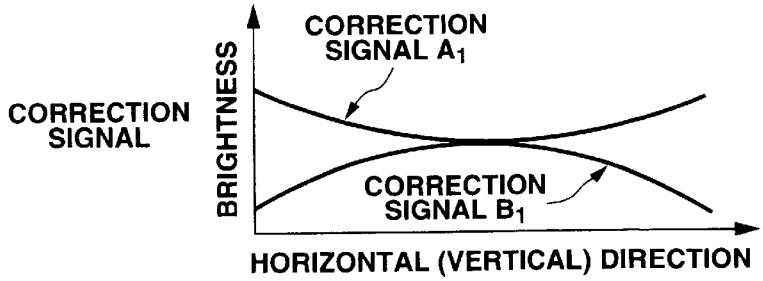
Figure 3A:
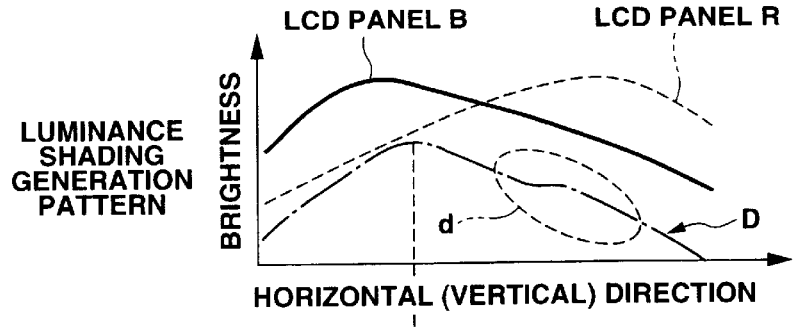
FIGS. 3(*a*) and (*b*) are explanatory views to illustrate the concept of the phase control for the color shading correction device in FIG. 1.
Figure 3B:
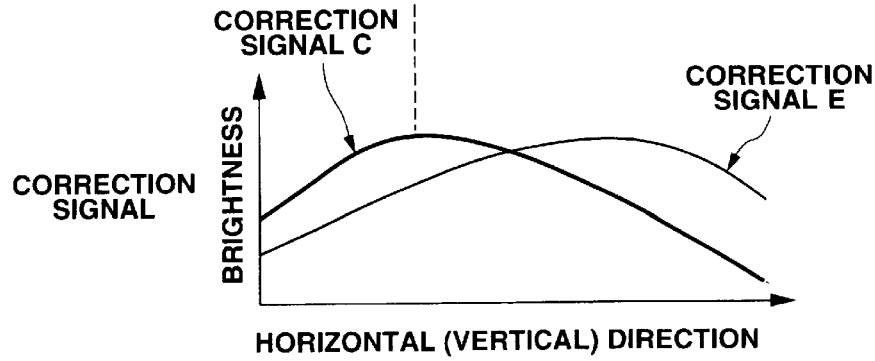
Figures 1, 2, 3, 7A, 7B, 7C, 7D:
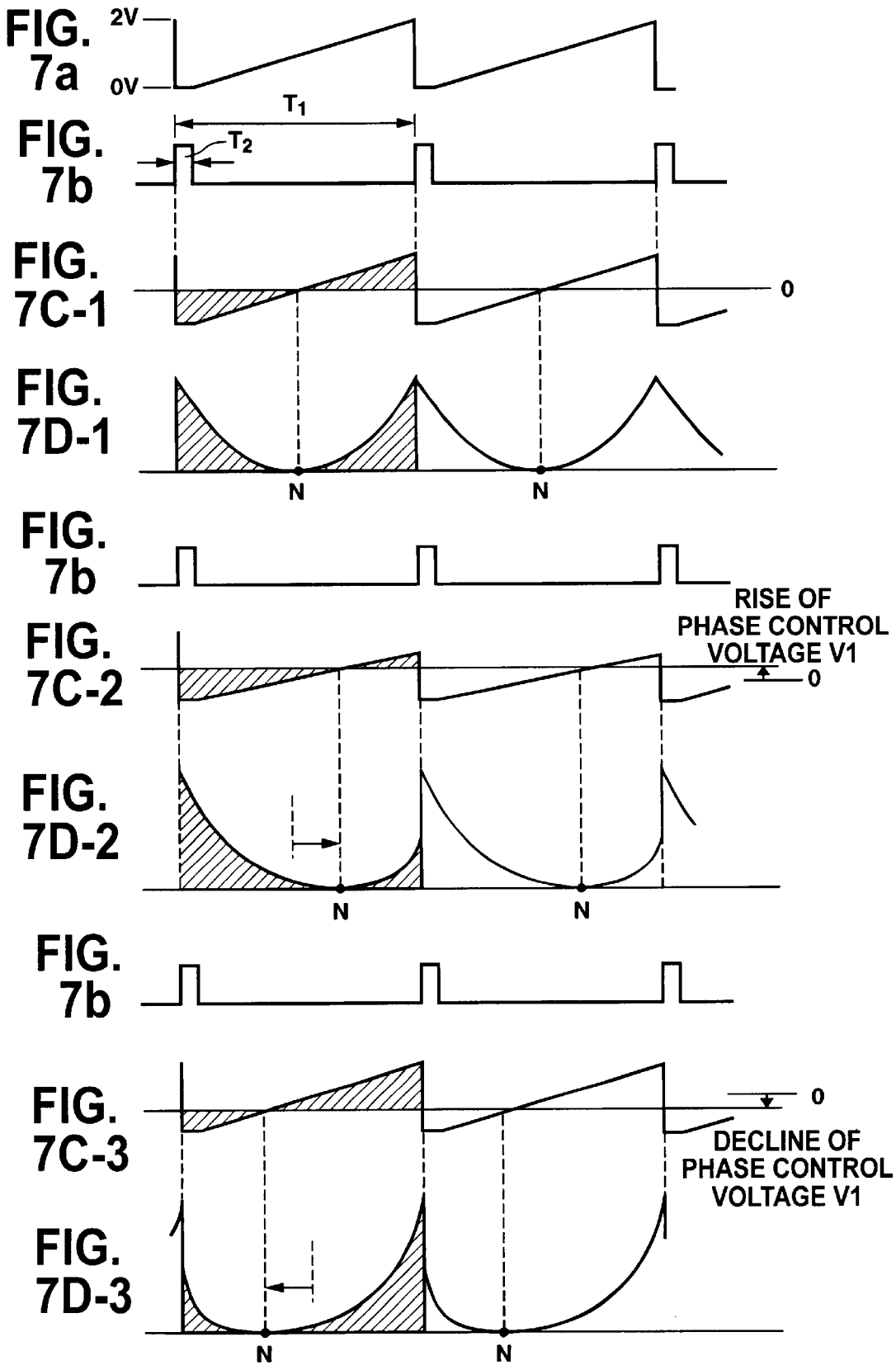
Figure 16:
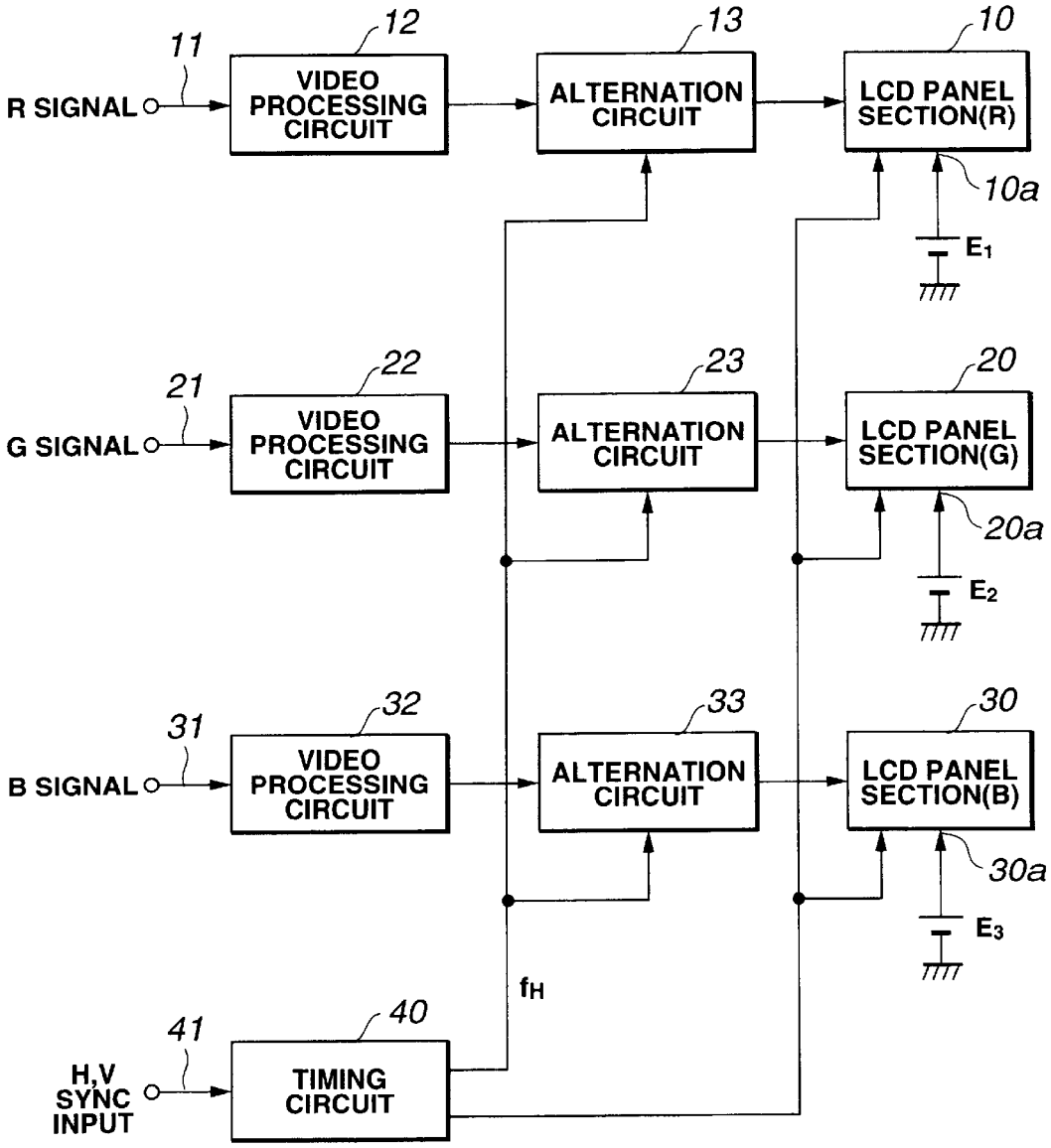
FIG.16 (RELATED ART)
FIG. 16 is a block diagram showing an example of the liquid crystal driving circuit used in a conventional three-panel type LCD data projector.
Figure 17:
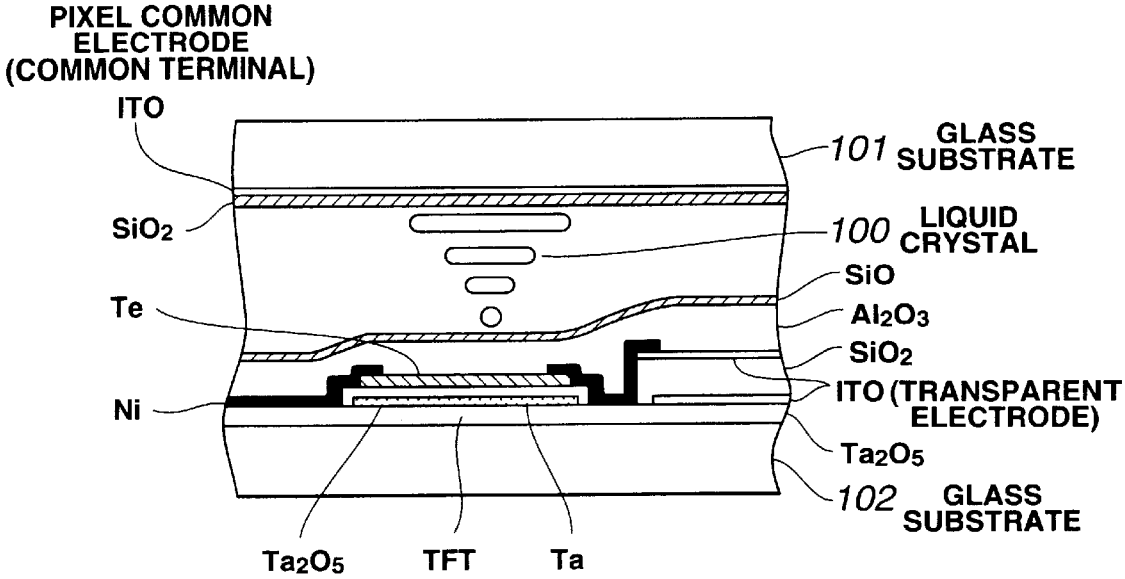
FIG.17 (RELATED ART)
FIG. 17 is a sectional view illustrating the structure of an LCD panel.
Figure 18:
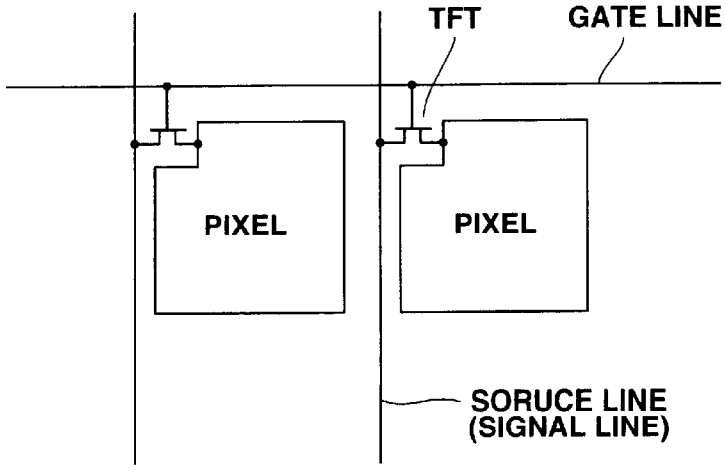
FIG.18 (RELATED ART)
FIG. 18 is a plan configuration view illustrating the LCD panel in FIG. 17.
Figure 19:
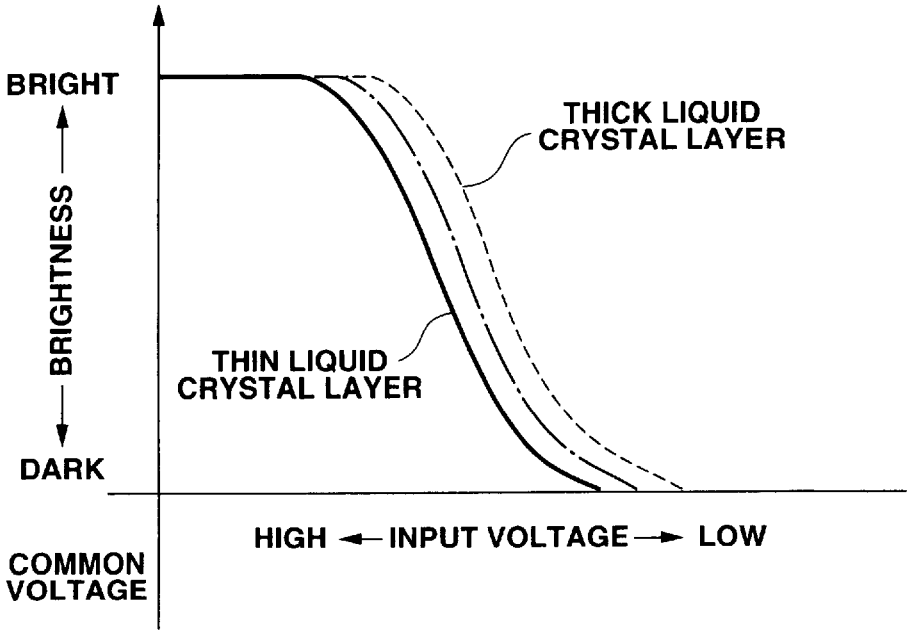
FIG.19 (RELATED ART)
FIG. 19 is a diagram showing the difference in brightness in response to the thickness of the liquid crystal layer.

FIG. 1 is a block diagram illustrating a color shading correction device according to an embodiment of the present invention and, FIGS. 2(*a*), (*b*), 3(*a*) and (*b*) are explanatory views to illustrate the concept of color shading correction method according to the present invention. The LCD driving circuit used in the three-panel type LCD data projector requires, as shown in FIG. 16, three driving circuit channels R, G and B. However, the driving circuit channels for R, G and B have substantially the same configuration and, to simplify the explanation, the LCD driving circuit channel for R alone will be described in this embodiment.

This embodiment is different from a conventional example of FIG. 16 in that it is provided with an adder 51 and a correction circuit 50 between a video processing circuit 12 and an alternation circuit 13 so that the correction signal from the correction circuit 50 is added to the video signal supplied to an input end of the adder 51.

The video signal for R input to an input terminal 11 is supplied to an input end of the adder 51 via the video processing circuit 12 as shown in FIG. 1. The video processing circuit 12 is a circuit for the processing such as clamping, amplification, and gamma correction of the R video signal. To the other input end of the adder 51, the correction signal from the correction circuit as described later is supplied. The correction circuit 50 changes the correction signal according to the video signal supplied to the input terminal 11 or to the video signal processed by the video processing circuit 12 so as to adjust the correction amount.

The correction circuit 50 generates the correction signal to correct the luminance shading caused by uneven thickness of the LCD panels in an LCD panel section 10. The correction circuit generates the gradually changing correction signal so as to have smaller amplitude at positions closer to the center in the horizontal direction of the LCD panel and, when the signal is seen vertically, to have smaller amplitude at positions closer to the center in the vertical direction, or a gradually changing correction signal so as to have larger amplitude at positions closer to the center in the horizontal direction of the LCD panel and to have larger amplitude at positions closer to the center in the vertical direction, and modulates the correction signal using the signal in the low frequency range components of the video signal supplied to the LCD panel.

Further connected to the correction circuit 50 is a setting means 50A for setting of the correction amount such as the luminance shading and color shading before shipment of the device. When the setting means 50A is operated, the correction circuit 50 is controlled so that the gain (amplitude) and phase of the correction signal are adjusted.

The concept of color shading correction in the color shading correction device according to the present invention is described with referring to FIGS. 2(*a*) and (*b*).

To solve the problems as described above, this embodiment of the present invention adopts the color shading correction method including the gain control as shown in FIGS. 2(*a*) and (*b*) and phase control as shown in FIGS. 3(*a*) and (*b*).

Suppose, for example, there are two types of LCD panels R and B with luminance shadings of different generation patterns as shown in FIG. 2(*a*). When there is a large difference in generation state of luminance shading between the area near the center and that at the periphery of the screen and there also is a difference in brightness at the periphery between the LCD panel R and the LCD panel B, the correction signal A1 as shown in FIG. 2(*b*) is added to the R signal so that, as a result, the luminance shading characteristics of the LCD panel R can be approximated to that of the LCD panel B shown in broken line in FIG. 2(*a*). In other words, by controlling the gain (amplitude) of the correction signal added to the R signal in response to the pattern (position) of the luminance shading on the LCD panel B, the luminance shading generation pattern can be approximated. In short, approximation of the luminance shading generation patterns on different LCD panels results in enabling suppression of the color shading generated in the synthesized color image.

On the other hand, the luminance shading generation pattern on the LCD panel B cannot be corrected with the correction signal A1 as described above to approximate to the luminance shading generation pattern on the LCD panel R. In such case, addition of the correction signal in reversed phase like B1 in FIG. 2(*b*) results in approximation to the luminance shading characteristics of the LCD panel R as shown in solid line in FIG. 2(*a*). As in the case above, approximation of the luminance shading generation pattern on different LCD panels enables, as a result, suppression of the color shading generated in the synthesized color image.

Suppose that there are two types of LCD panels R and B with luminance shadings in different generation patterns as shown in FIG. 3(*a*). For example, when the brightest area phase is displaced to the right side of the figure on the LCD panel R and the brightest area phase is displaced to the left side of the figure on the LCD panel B, the correction signal like C in FIG. 3(*b*) is added to the R signal. This results in a luminance shading characteristics shown as D in dashed line in FIG. 3(*a*). Then, by adjusting the DC level, the luminance shading characteristics of the LCD panel R can be approximated to the luminance shading characteristics of the LCD panel B. The correction signal of D has its level slightly rising at a position near the area d as shown in broken line.

On the other hand, to approximate the luminance shading pattern as generated on the LCD panel B to the luminance shading pattern generated on the LCD panel R, it is sufficient to add the correction signal like E as shown in FIG. 3(*b*) to the B signal. Thus, by adjusting the gain (amplitude) and phase of the correction signal to correct the luminance shading in response to the luminance shading status on the LCD panels, the luminance shading generation patterns on the different LCD panels can be made approximate and, as a result, color shading generated in the synthesized color image can be suppressed.

Further, even if the luminance shading patterns generated on the LCD panels R, G and B are not adjusted according to that on one of these panels, the luminance shading characteristics on each of LCD panels R, G and B can be corrected by generating the correction signal to approximate them to a pattern as the common reference for approximation of the luminance shading generation patterns for R, G and B.

Figure 4:
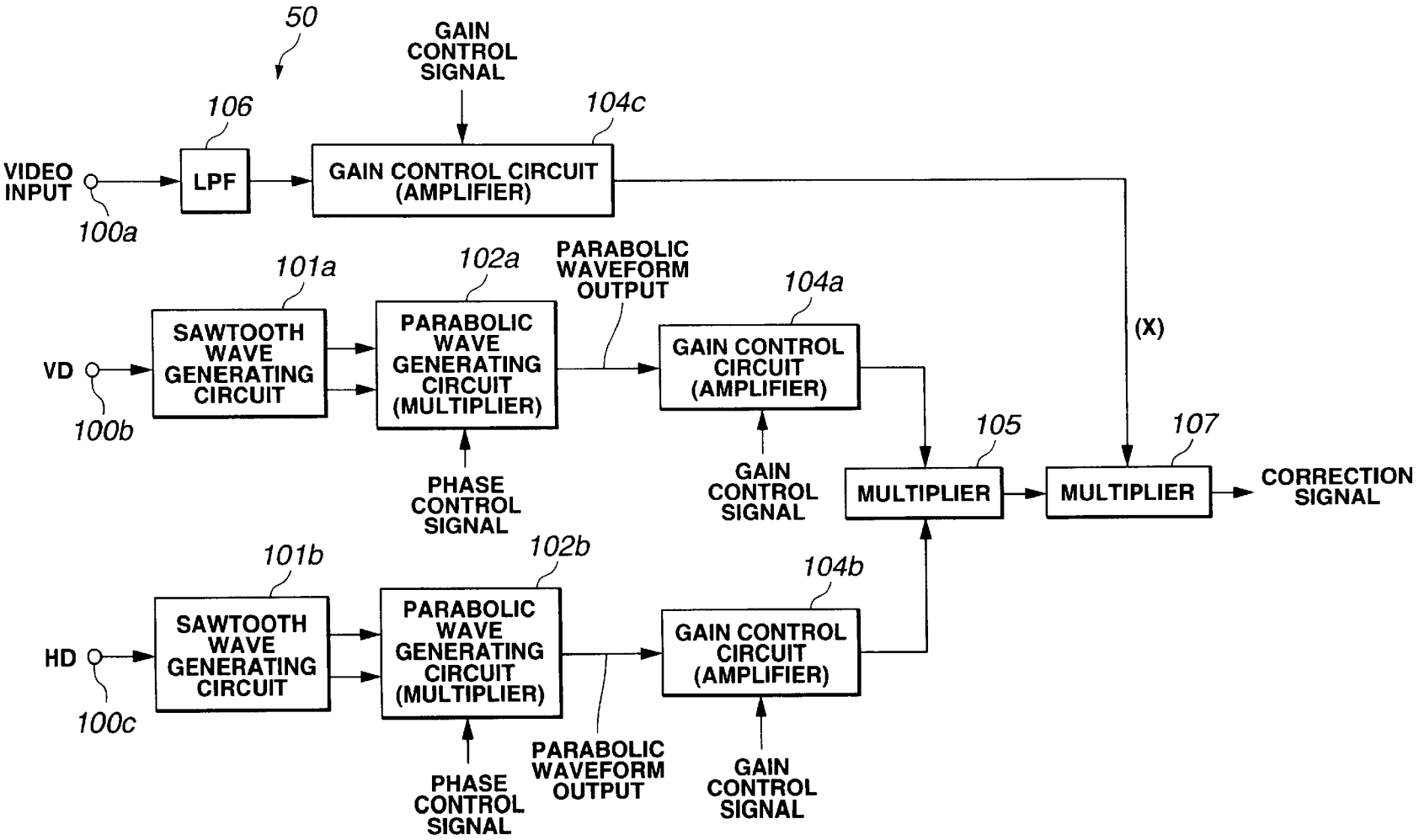
FIG. 4 is a block diagram illustrating a configuration example of the correction circuit in FIG. 1.
Figure 5:
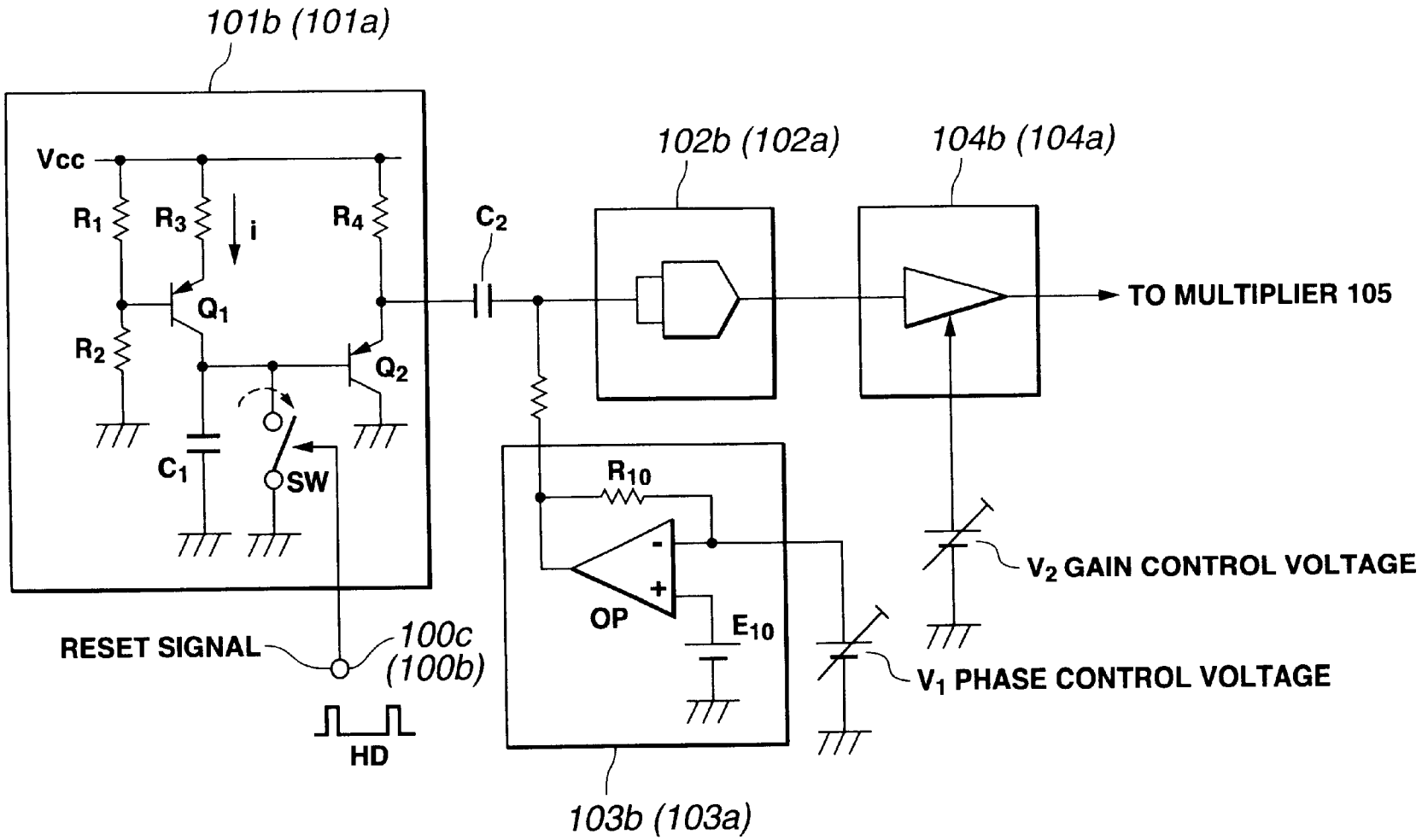
FIG. 5 is a circuit configuration diagram illustrating a specific example of the horizontal sync parabolic wave circuit section in the correction circuit of FIG. 4.

FIGS. 4 and 5 show a configuration example of the above correction circuit 50. FIG. 4 is a block diagram to illustrate the schematic configuration of the correction circuit and FIG. 5 is a circuit configuration diagram showing a specific example of parabolic wave generating circuit sections (100*c*, 101*b*, 102*b*, 103*b* and 104*b*) of the correction circuit in the horizontal period. FIGS. 7(*a*), (*b*), (*c*1), (*d*1), (*c*2), (*d*2), (*c*3) and (*d*3) show output waveforms of the correction circuit in the applicable circuit sections. With the vertical sync signal VD input instead of the horizontal sync signal HD as the reset signal, the circuit of FIG. 5 can be adapted to be parabolic wave generating circuit sections (100*b,* 101*a,* 102*a,* 103*a* and 104*a*) in the vertical period.

As shown in FIG. 4, the correction circuit 50 comprises a terminal 100*a* to which the video signal supplied to the input terminal 11 or the video signal processed by the video processing circuit 12 is input and a video gain control circuit channel (106 and 104*c*) to adjust the gain of the video signal input to the terminal 100*a*. It also comprises the input terminal 100*b* to which the vertical sync signal VD is input from a timing circuit 40, a circuit channel (including 101*a,* 102*a* and 104*a*) to output a parabolic wave in the vertical period, an input terminal 100*c* to which the horizontal sync signal HD from the timing circuit 40 is input and a circuit channel (including 101*b,* 102*b* and 104*b*) to output a parabolic wave in the horizontal period. It further comprises a first multiplier 105 to generate the correction signal by multiplying the output from the circuit channel to generate a vertical parabolic wave and the output from the circuit channel to generate a horizontal period parabolic wave and a second multiplier 107 to multiply the output from the first multiplier 105 and the output from the video gain control circuit channel as above. The second multiplier 107 constitutes a means to modulate the amplitude of the correction signal from the first multiplier 105 in response to the amplitude level of the low frequency range components of the video signal from the video gain control circuit channel.

Now, FIG. 4 is described in detail. The video signal input via the terminal 100*a* is provided to a low-pass filter (LPF) 106. The LPF 106 removes the high frequency range components from the input video signal and outputs the low frequency range components only. In other words, the low frequency range components of the input video signal only are supplied to a subsequent gain control circuit 104*c*.

The gain control circuit 104*c* is an amplifier required to obtain the auxiliary signal (x) in response to the low frequency range components or the brightness of the input video signal. It enables adjustment of the amplitude of the signal (x) in response to the brightness with the control signal. Output from the amplifier 104*c* is provided to the second multiplier 107.

Referring to the auxiliary signal obtained by the LPF 106 and the gain control circuit 104*c* above as (x), the auxiliary signal (x) is a correction signal with its gain controlled so that the control amount changes in response to the height of the input voltage for correction of the luminance shading caused by difference in the liquid crystal layer thickness. Specifically, even when the brightness change characteristics change in response to the height of the input voltage due to difference in the crystal layer thickness, the luminance shading can be removed at a higher precision with using the above auxiliary signal (x). Such removal is described below with referring to FIGS. 6(*a*) and (*b*).

Figure 6A:
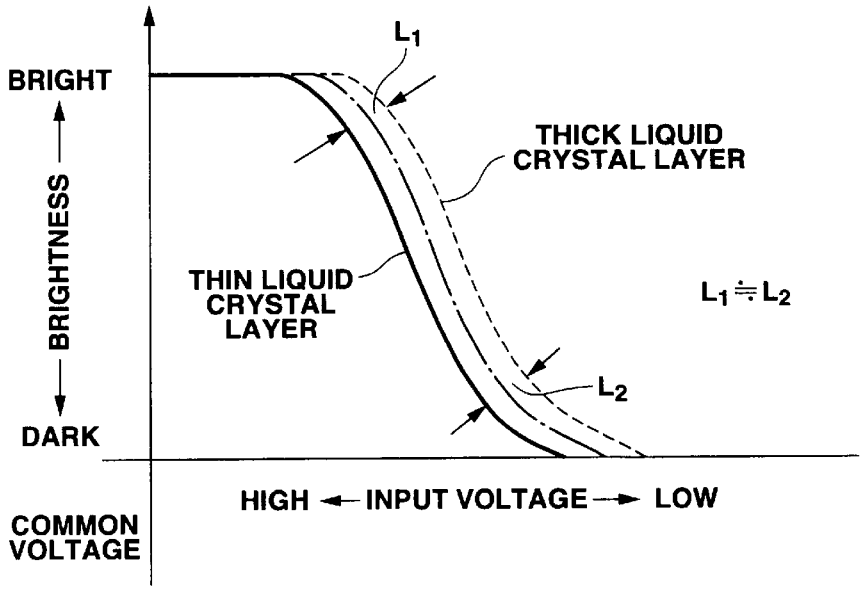
FIGS. 6(*a*) and (*b*) are characteristic diagrams comparing the brightness change characteristics in response to the change in the input voltage to the LCD panel as conventionally considered and the actual brightness change characteristics in response to the change in the input voltage.
Figure 6B:
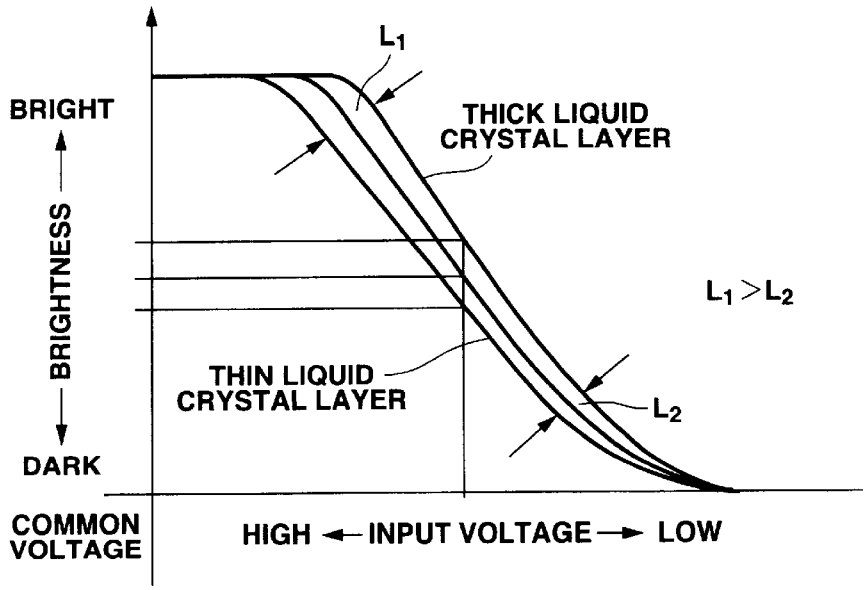

For changes in the liquid crystal layer thickness, conventionally, the brightness (vertical axis) has been considered to change in the same way as the input voltage (horizontal axis) changes as shown in FIG. 6(*a*).

With various data actually taken, however, it is found that the characteristics are as shown in FIG. 6(*b*). Specifically, for a different thickness of the liquid crystal layer, the brightness change characteristics (vertical axis) change in response to the change in input voltage (horizontal axis). Therefore, it becomes necessary to change the correction amount in response to the height of input voltage for correction of the luminance shading, which is generated by difference in the liquid crystal layer thickness. In other words, a larger correction amount is to be applied when the input voltage is high and a smaller amount is applied when the input voltage is low. According to the embodiment of the present invention, it becomes theoretically possible to effectively eliminate the luminance shading with the characteristics as shown in FIG. 6(*b*) due to uneven thickness of the liquid crystal layer by supplying, to the adder 51, a correction signal obtained by multiplication of the above auxiliary signal (x), acquired by providing a means consisting of the LPF106 and the multiplier 107, and the correction signal from the multiplier 105.

On the other hand, the circuit channel to generate the parabolic wave in the vertical period consists of an input terminal 100*b* to which the vertical sync signal VD from a timing circuit 40 is supplied, a sawtooth wave generating circuit 101*a,* a parabolic wave generating circuit 102*a* and a gain control circuit 104*a*.

Similarly, the circuit channel to generate the parabolic wave in the horizontal period consists of an input terminal 100*c* to which the horizontal sync signal HD from a timing circuit 40 is supplied, a sawtooth wave generating circuit 101*b,* a parabolic wave generating circuit 102*b* and a gain control circuit 104*b*.

Since both of the vertical period parabolic wave generating circuit channel and the horizontal period parabolic wave generating circuit channel have similar circuit configurations, the horizontal period parabolic wave generating circuit shown in FIG. 5 is explained below with omitting the explanation about the vertical period parabolic wave generating circuit.

As shown in FIG. 5, the sawtooth wave generating circuit 101*b* comprises a supply line of DC power supply Vcc, resistors R1 to R4, transistors Q1 and Q2, a capacitor C1 and a switch SW. In the circuit, the current i flowing through Q1 charges the capacitor C1, which is discharged when the switch SW is turned on (Refer to the output waveform of the capacitor C1 as shown in FIG. 7(*a*)). The switch SW makes switching operation in response to the sync signal from the timing circuit 40 (Horizontal sync signal HD in this case. For the vertical period parabolic wave generating circuit channel, this signal is the vertical sync signal VD). The sync signal is used as the reset signal (Refer to the HD signal waveform as shown in FIG. 7(*b*)). When the reset signal is supplied while the capacitor C1 is being charged, the switch SW is turned on and the charge of the capacitor C1 is discharged. Thus, the sawtooth wave as shown in FIG. 7(*a*) is generated.

Considering a single period of the sync signal to be T1 and the current flowing the emitter and collector paths of the transistor Q1 to be i, the pulse period of the sync signal to be T2 and the capacity of the capacitor C1 to be C1, the wave height V of the sawtooth wave can be determined by $V=i\times T1/C1$.

The parabolic wave generating circuit 102*b* comprises a multiplier and multiplies two sawtooth wave signals i.e. squares the sawtooth wave signal from the sawtooth wave generating circuit 101*b*. The sawtooth wave from the sawtooth wave generating circuit 101*b* has its DC cut at the capacitor C2 and is supplied to the two input terminals of the multiplier. The sawtooth wave which flows through the capacitor C2 and is input to the parabolic wave generating circuit 102*b* shows the waveform at the equivalent level for both positive and negative directions around zero (0) volt (Refer to the waveform shown in FIG. 7(*c*1)). By squaring this, the parabolic wave is generated (Refer to the waveform shown in FIG. 7(*d*1)). The center position of the parabolic wave (Bottom) is identical to the center point (0) of the sawtooth wave. In the explanation, the center position of the parabolic wave thus identical to the center point (0) of the sawtooth wave is sometimes called the vertex N.

A phase control circuit 103*b* comprises an operation amplifier OP, a voltage source E10 and a resistor R10. By adjusting the voltage V1 of the voltage source V1 for phase control, the zero crossing point of the sawtooth wave i.e. the vertex N of the parabolic wave (i.e. the phase) can be changed.

FIGS. 7(*c*2) and (*c*3) show such situation. The waveform *c*1 as shown in FIG. 7(*c*1) represents the case where the positive and negative levels of the sawtooth wave (amounts shown as shaded sections) are identical. The parabolic wave *d*1 in this case (refer to FIG. 7(*d*1)) becomes symmetrical with its vertex N at the center of the period T1.

When the phase control voltage V1 is changed, the balance between the positive and negative sides of the sawtooth wave is changed as shown in FIGS. 7(*c*2) and (*c*3). The parabolic waveforms *d*2 and *d*3 obtained by squaring of them (Refer to FIGS. 7(*d*2) and (*d*3)) present different levels for the right and left and the vertex N of the parabolic wave (i.e. phase) moves to the right or left of the figure.

FIG. 8(*c*4) shows the sawtooth wave when the phase control voltage V1 is lowered by the maximum value $\alpha$ and FIG. 8(*d*4) shows the parabolic wave at that time. The phase of the parabolic wave moves to the right end here. On the contrary, FIG. 8(*c*5) shows the sawtooth wave when the phase control voltage V1 is raised by the maximum value $\alpha$ and FIG. 8(*d*5) shows the parabolic wave at that time. In this case, the phase of the parabolic wave moves to the left end.

Therefore, it is possible to shift the phase of the correction signal in response to the center position of the luminance shading occurring on the LCD panel by adjusting the phase control voltage V1.

The gain control circuit 104*b* changes the output amplitude of the parabolic wave generating circuit 102*b* and can adjust the amplitude of the output signal in response to the voltage V2 from the gain control voltage source V2. Similar operation is applied to the vertical period parabolic wave generating circuit channel and the amplitude of the output signal can be adjusted.

Figure 21:
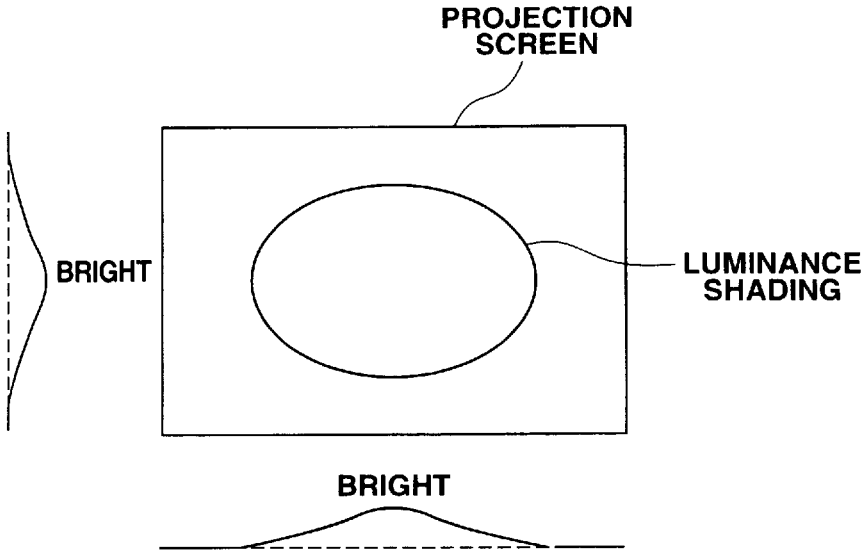
FIG.21 (RELATED ART)
FIG. 21 is a diagram illustrating how the luminance shading appears.
Figure 20A:
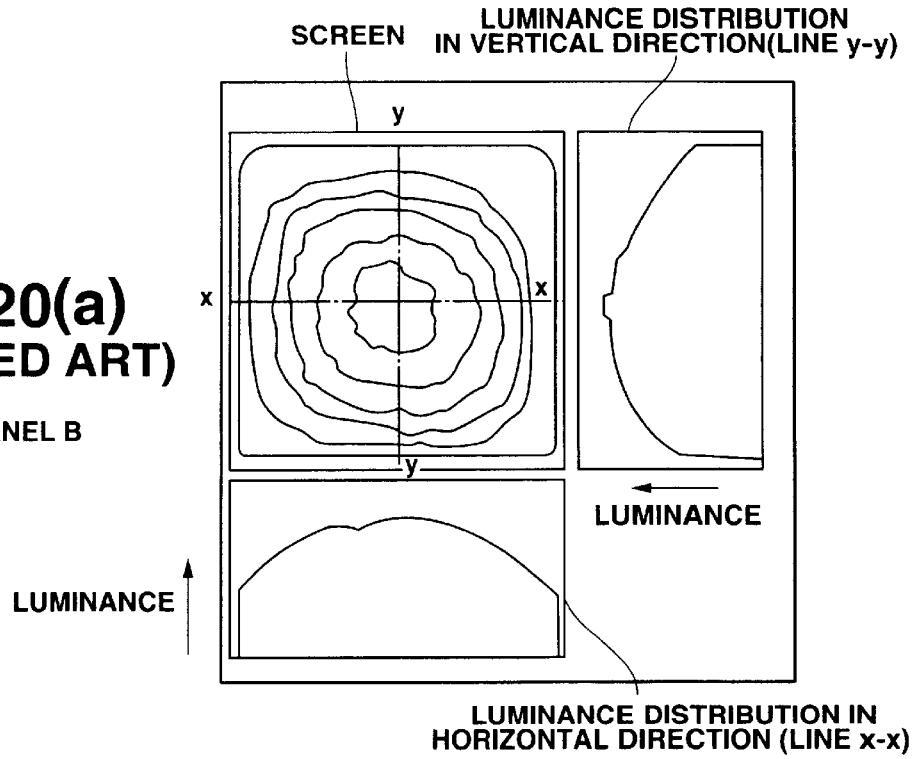
FIG.20(a) (RELATED ART)
FIGS. 20(*a*) and (*b*) are explanatory views to illustrate an example of generation patterns of the luminance shadings on the LCD panels B and R.
Figure 20B:
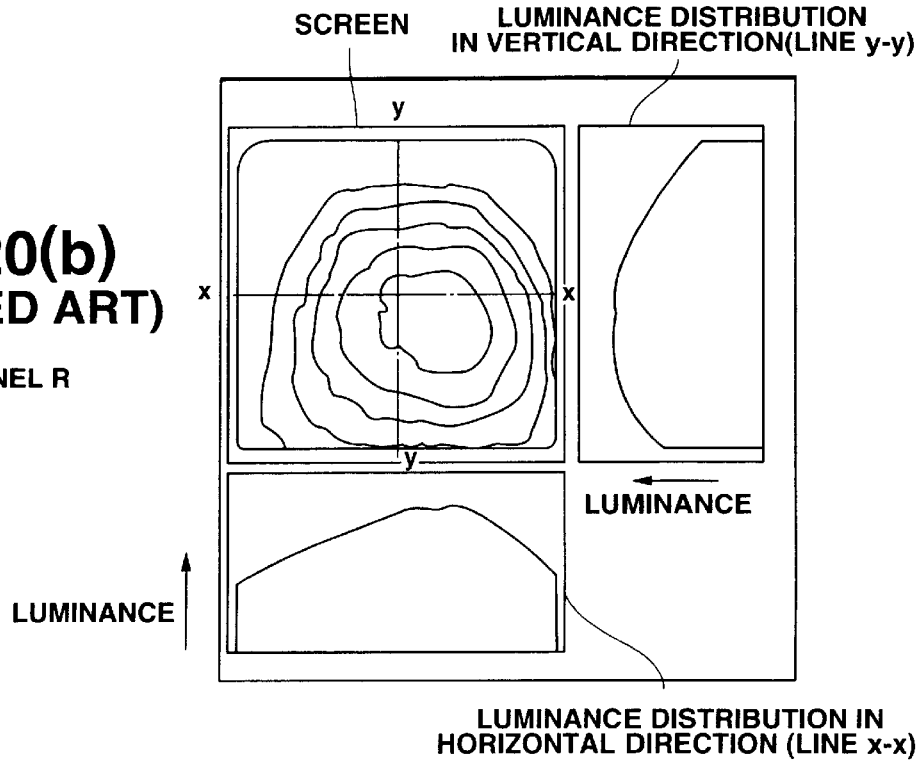
FIG.20(b) (RELATED ART)

Thus, the signal with its amplitude adjusted by the vertical periodparabolic wave generating circuit channel and the horizontal period parabolic wave generating circuit channel is supplied to the first multiplier 105 shown in FIG. 4 and, after its multiplication processing, the second multiplier 107 multiplies the correction signal from the first multiplier 105 by the auxiliary signal (x) from the video gain control circuit channel so that the obtained signal is supplied to the adder 51 as the correction signal. In other words, by modulating the multiplication wave made by two parabolic waves obtained by the vertical and horizontal period parabolic wave generating circuits with the amplitude of the video signal, the luminance shading correction signal which is suitable to the luminance shading extended two-dimensionally as shown in FIG. 21 and also suitable to the video input level of FIG. 6(*b*) can be obtained.

Figure 9:
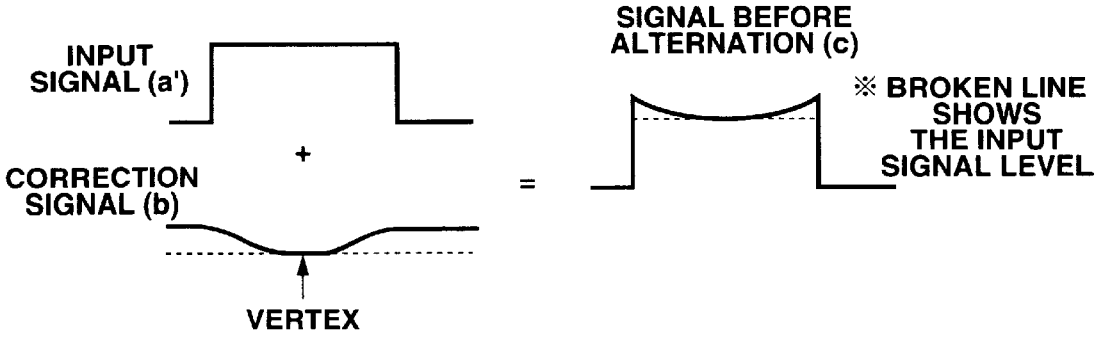
FIG. 9 is a waveform diagram to illustrate correction of the luminance shading and color shading in FIG. 1.

The adder 51 adds the correction signal (b) to the video signal (a') processed for video as shown in FIG. 9 so that the video signal (c) with the correction signal added to is provided to the alternation circuit 13. Signals (a'), (b) and (c) in FIG. 9 correspond to the signals (a'), (b) and (c) of various sections in the circuit.

In FIG. 1, the alternation circuit 13 reverses the polarity of the R video signal for every horizontal period with both AC and DC voltages of the video signal corrected as above in order for AC driving of the liquid crystal. Specifically, for the DC level (Common voltage) E1 at a common electrode 10*a* of the LCD panel kept at +7.5 V, for example, with reference to 0 V on the substrate, the polarity of the video signal as corrected above is reversed. The polarity reversing for every horizontal period in the alternation circuit 13 is executed using the alternating pulse fH from the timing circuit 13. The video signal with the polarity reversed for every horizontal period output from the alternation circuit 13 is input to the LCD panel section 10.

The LCD panel section 10 comprises a drive circuit and an LCD panel to form pictures R. The drive circuit is provided with a sample/hold circuit to which the signal for R with its polarity reversed for every horizontal period from the alternation circuit 13 is input and which samples and holds the signal, a horizontal driver circuit which supplies the sampled/held signal to the signal line (source line) of the pixels on the LCD panel, and a vertical driver circuit which drives the gate line. To the LCD panel section 10, R video signal among the primary color signals RGB is supplied from the alternation circuit 13 for R. At the same time, clock and timing pulses required for display of the output signal from the alternation circuit 13 for R are supplied from the timing circuit 40.

The timing circuit 40 generates the alternating pulse fH for the alternation circuit 13 and the clock and timing pulses to drive the LCD panel section 10 using the horizontal and vertical sync signals (HD and VD) input from an input terminal 41. It also generates the timing signal for timing adjustment of the correction signal generated by the correction circuit 50 for the picture period of the input video signal.

Figure 10A:
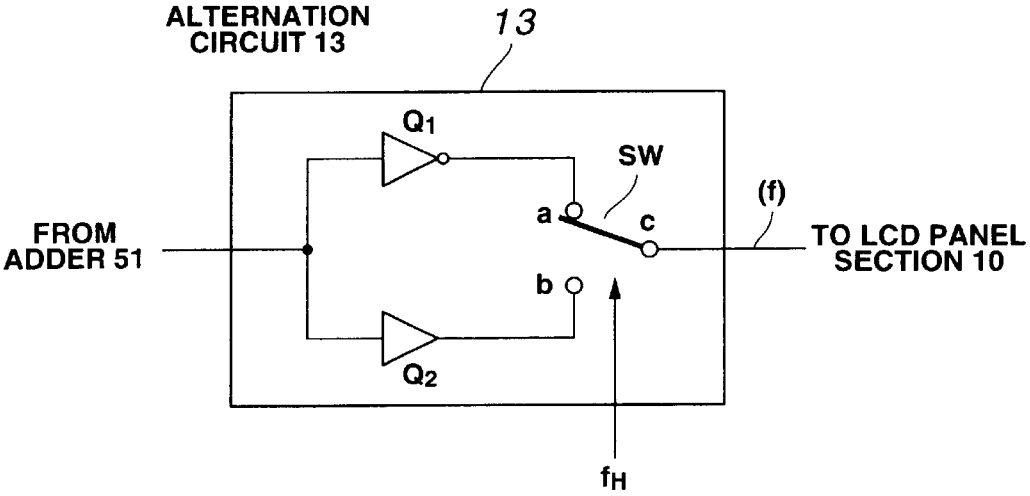
FIGS. 10(*a*) to (*c*) are diagrams to illustrate a configuration example of the alternation circuit in FIG. 1.
Figure 10B:
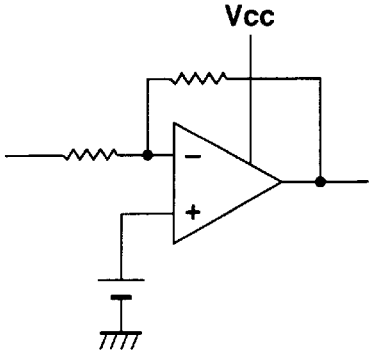
Figure 10C:
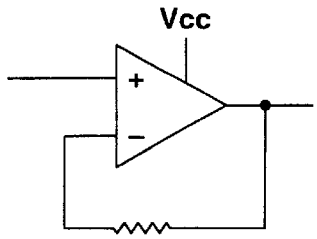

FIG. 10(*a*) shows a configuration example of the above alternation circuit 13. The video signal from the adder 51 to which the correction signal has been added is supplied to an inverting amplifier Q1 and a non-inverting amplifier Q2 and, these inverting amplifier Q1 and non-inverting amplifier Q2 form two types of video signals (with positive and negative polarities). FIGS. 10(*b*) and (*c*) show configuration examples for the inverting amplifier Q1 and the non-inverting amplifier Q2. Inverting amplifier Q1 comprises an operation amplifier, two resistors and a DC power supply. Non-inverting amplifier Q2 comprises an operation amplifier and a resistor. With such configuration, the output from the inverting amplifier Q1 and the output from the non-inverting amplifier Q2 can be formed into waveform outputs with reversed polarities symmetrical to the central potential (7.5 V) (See FIG. 11(*d*)). These video signals formed with positive and negative polarities are supplied to the corresponding input terminal a or b of the switching means SW. Then, the switching means SW switches between the input terminals a and b for every horizontal period according to the alternating signal fH supplied from the timing circuit 40. This makes the output from the output terminal c to be the video signal switched to positive and negative polarities for every horizontal period (Refer to FIG. 11(*f*)). This means that the video signal in response to the driving method with 1H polarity reversing for the LCD panel section 10 can be obtained.

Figures 11A, 11B, 11C, 11D, 11E, 11F:
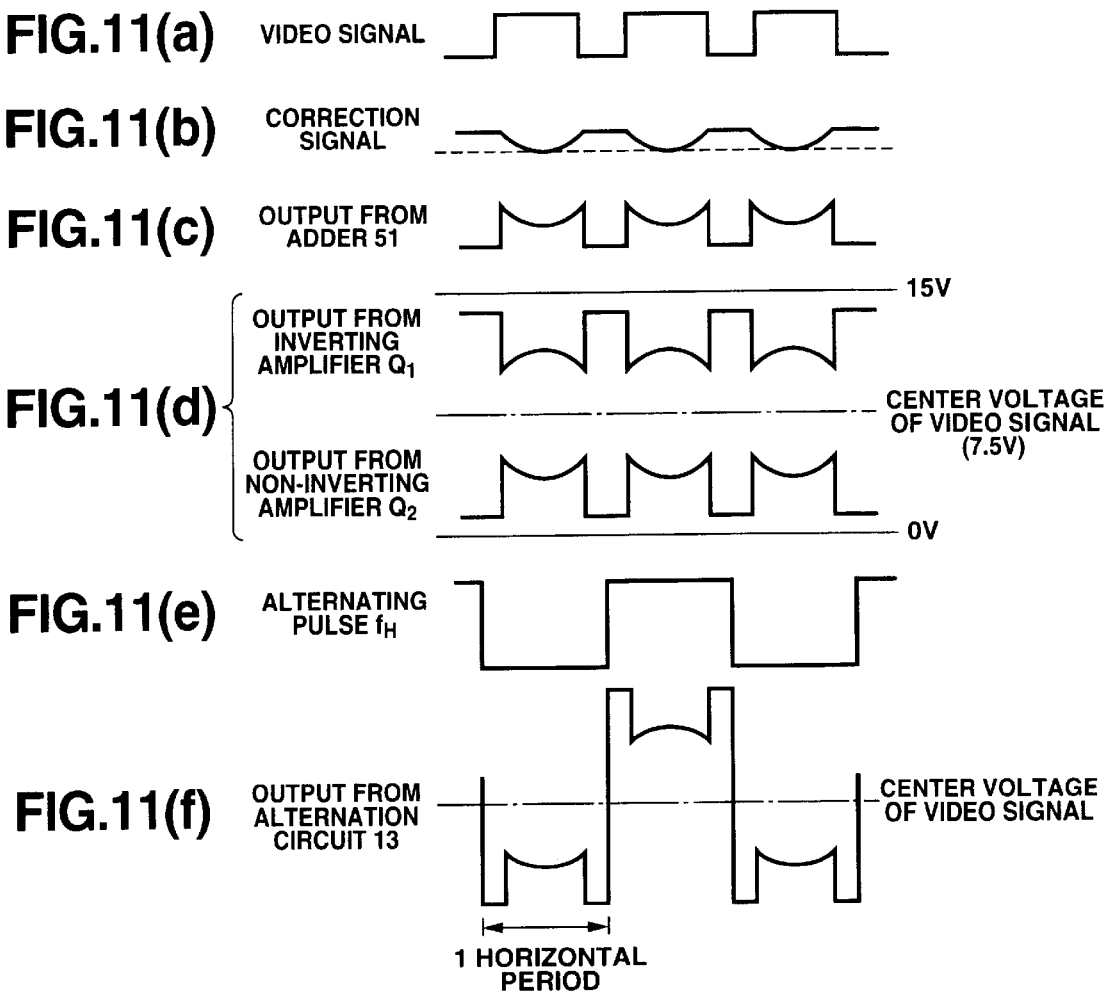
FIGS. 11(*a*) to (*f*) are waveform diagrams illustrating the operation of the device in FIG. 1.

Then, the operations of the above devices (FIG. 1 and FIGS. 10(*a*) to (*c*)) are described with referring to FIGS. 11(*a*) to (*f*).

FIG. 11(*a*) shows the video signal input at the input terminal 11 and processed by the video processing circuit 12, FIG. 11(*b*) shows the correction signal from the correction circuit 50, FIG. 11(*c*) shows the addition output obtained by adding the correction signal of FIG. 11(*b*) above to the signal of FIG. 11(*a*) above, FIG. 11(*d*) shows two types (positive polarity and negative polarity) of video signals generated by the inverting amplifier Q1 and the non-inverting amplifier Q2 in the alternation circuit 13 of FIG. 10(*a*), FIG. 11(*e*) shows the alternating pulse fH for every horizontal period from the timing circuit 40 and FIG. 11(*f*) shows the alternation output switched from the two types of video signals in amplifiers Q1 and Q2 shown in FIG. 11(*d*) by the switching means SW of FIG. 10(*a*) using the alternating pulse fH of FIG. 11(*e*). The alternation output shown in FIG. 11(*f*) is, when applied to the LCD panel section 10, applied with its video signal center voltage shifted to the level of the common polarity voltage E1 on the LCD panel (+7.5V, for example).

The video processing circuit 12 executes video processing such as amplification so as to obtain the video signal (a). The correction circuit 50 generates the correction signal(b) based on the horizontal and vertical sync signals (HD and VD) from the input terminal 41 and the video signal (a). The adder 51 outputs the signal (c) which is the sum of the video signal (a) and the correction signal (b). The alternation circuit 13 generates the video signal (f) obtained by reversing the polarity of the addition signal (c) for every horizontal period using the alternating pulse (e) and supplies it to the LCD panel section 10.

Figures 12A, 12B, 12C:
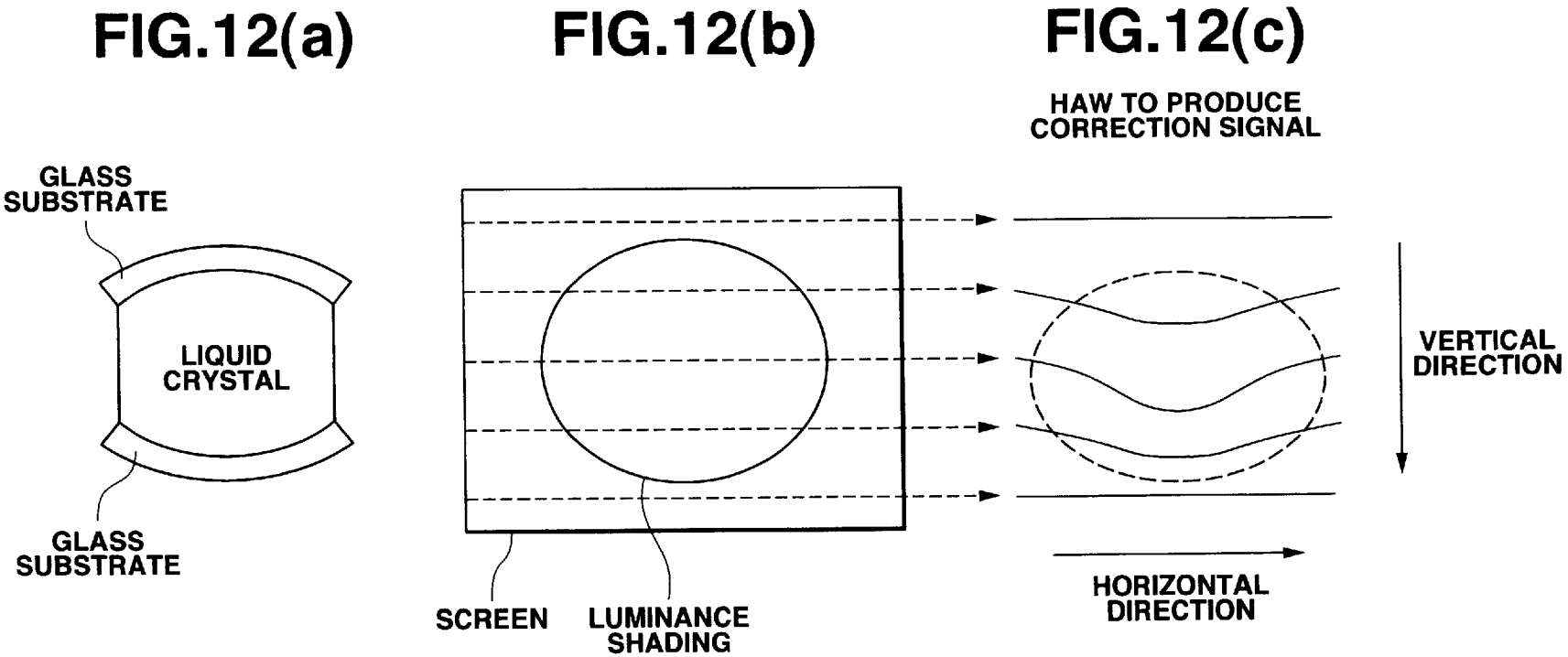
FIGS. 12(*a*) to (*c*) are explanatory views to illustrate an example of luminance shading caused by uneven gap on the LCD panel and the method to produce the correction signal to cancel the same.

FIGS. 12(*a*) to (*c*) explain how the correction signal is produced to cancel the luminance shading caused by uneven gap generated on the LCD panel.

FIG. 12(*a*) shows uneven thickness of the LCD layer (uneven gap) in the LCD panel. This figure shows an example of uneven gap with projection at the center (or in some cases uneven gap may result in recess at the center).

FIG. 12(*b*) shows the luminance shading generated on the screen due to uneven gap of FIG. 12(*a*) above. The screen becomes brighter at positions closer to the center (or darker at positions closer to the center).

FIG. 12(*c*) shows how to produce the correction signal by the correction circuit 50. Substantially at the center of the screen, the correction signal as shown in FIG. 7(*d*1) is generated and supplied to the adder 51, but at the top and bottom of the screen, such correction signal is not particularly generated because no luminance shading is observed. Therefore, with reference to the top and bottom of the screen, the correction circuit 50 needs a circuit to obtain the gradualy changing correction signal which has larger amplitude at positions closer to the center in the horizontal direction of the LCD panel and, when seen in the vertical direction, has larger amplitude at positions closer to the center in the vertical direction and to modulate it with the amplitude of the video signal. By generating the correction signal in the way suitable to uneven gap pattern or the luminance shading pattern as far as possible, the luminance shading can be cancelled at a higher precision.

In case of a three-panel type LCD projector, color shading is not caused in the synthesized color image when the luminance shadings generated on the LCD panels R, G and B are corrected so that they have the same pattern and then further corrected to achieve the same brightness characteristics. Therefore, when the three LCD panels have luminance shadings of different patterns, it is appropriate to adjust the gain (amplitude) and phase of the correction signal so as to adapt them to a certain reference (taking the brightest area on a certain LCD panel as the center phase, for example) by operating the setting means 50A as shown in FIG. 1. This results in approximation of the luminance shadings on the LCD panels R, G and B, which suppresses the color shading.

It is also acceptable to, by operating the setting means 50A, subject a certain LCD panel to no-correction processing without providing any correction signal, for example, and to control the gain and phase of the correction signals for the remaining LCD panels so that they have luminance shadings in the generation pattern similar to that on the above LCD panel. Thus, the luminance shading on the LCD panel subjected to no-correction processing remains as it is, but color shading generation can be prevented for the synthesized color image.

Further, the luminance shading pattern on the LCD panels R, G and B can be approximated to another pattern shape serving as the reference common to R, G and B.

Though the luminance shading caused by uneven gap on the LCD panel is corrected for color shading correction in this embodiment, it is naturally understood that, with the circuit configuration of this embodiment as shown in FIGS. 1, 4 and 5, the luminance shading caused by any factor other than uneven gap (caused by optical components such as projection lens, for example) can be corrected for color shading correction. Therefore, it is possible to correct the color shading of the LCD panels by simultaneously suppressing or correcting the luminance shadings generated on the projection screen due to various causes.

According to the embodiment described above, generation of the luminance shading on the LCD panel can be suppressed and, even when the luminance shading is generated in different ways on different LCD panels, color shading generation can be suppressed. Further, since the correction signal whose correction amount changes in response to the level of the video signal supplied to the LCD panel is generated with approximation of the luminance shading characteristics for the LCD panels, correction can be achieved at a higher precision. Such color shading correction device can be easily configured just by adding an additional circuit such as the correction circuit and can be realized at a low cost, and moreover it achieves a high correction characteristic.

Figure 13:
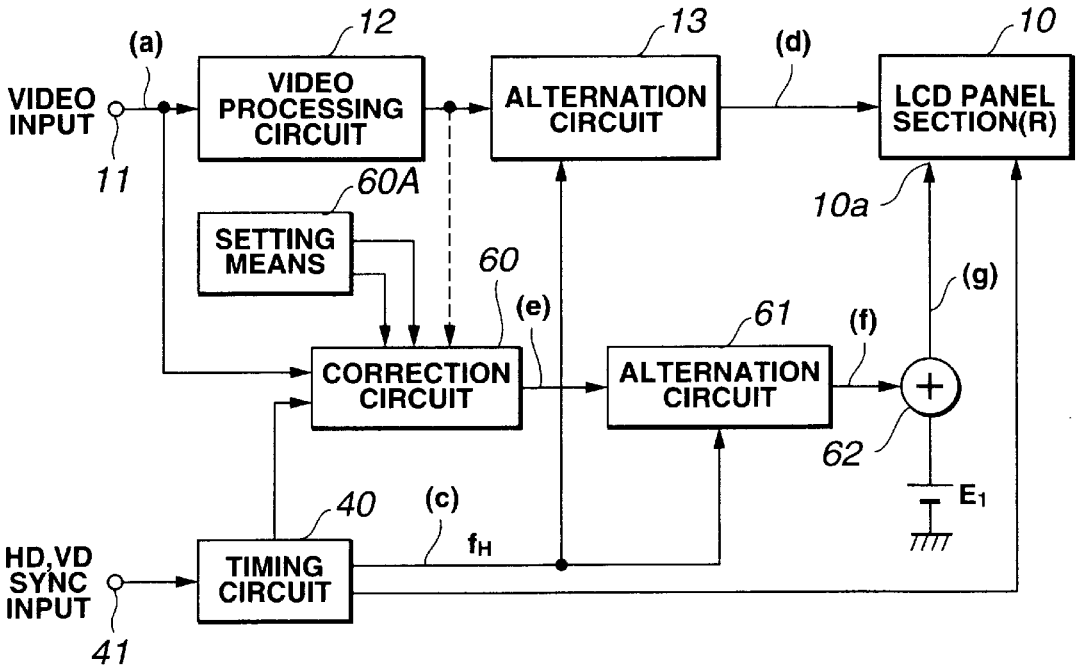
FIG. 13 is a block diagram illustrating a color shading correction device according to another embodiment of the present invention.

FIG. 13 is a block diagram of a color shading correction device according to another embodiment of the present invention. Since this device also has similar driving circuit channels for R, G and B, the driving circuit channel for R alone is described below and explanations about the driving circuit channels for G and B are omitted.

In this embodiment, the luminance shading is corrected by the common voltage. By adding with an adder 62 the correction signal (f) generated by a correction circuit 60 and an alternation circuit 61 to the common voltage E1 as shown in the conventional example of FIG. 16, the correction is made for every horizontal period. In other words, the correction is achieved by addition of the alternating correction signal (f) to the common voltage E1. Other configurations are as shown in FIG. 16.

The video signal R input to an input terminal 11 is, via a video processing circuit 12, supplied to an alternation circuit 13. The video processing circuit 12 is a circuit for clamping, amplification and gamma correction of the R input video signal. The alternation circuit 13 reverses the polarity of the R video signal for every horizontal period with both AC and DC voltages in order for AC driving of the liquid crystal.

Specifically, for the voltage at a pixel common electrode 10*a* of the LCD panel kept at +7.5 V, for example, with reference to 0 V on the substrate, the polarity of the video signal after video processing as described above is reversed. The polarity reversing in the alternation circuit 13 is executed using the alternating pulse fH from a timing circuit 13. The video signal with the polarity reversed for every horizontal period from the alternation circuit 13 is supplied to the LCD panel section 10. The alternation circuit 13 is, similar to the one explained referring to FIGS. 10(*a*) to (*c*), provided with an inverting amplifier Q1, a non-inverting amplifier Q2 and a switching means SW to switch between these amplifiers for every horizontal period.

The correction circuit 60 is a circuit for generation of the correction signal which corrects the luminance shading caused by uneven thickness of the liquid crystal layer in the LCD panel section 10 as in the case of the correction circuit 50 of FIG. 1. It generates the correction signal from the gradually changing signal which has smaller amplitude at positions closer to the center of the LCD panel in the horizontal direction and has smaller amplitude at positions closer to the center in the vertical direction when the signal is seen vertically or the gradually changing signal which has larger amplitude at positions closer to the center of the LCD panel in the horizontal direction and larger amplitude at positions closer to the center in the vertical direction. The circuit modulates such signal using the signal obtained by removing high frequency range components from the video signal to generate the correction signal. Specific configuration of the correction circuit 60 is the same as those in FIGS. 4 and 5.

The correction circuit 60 is also provided with a setting means 60A for correction processing setting of the luminance shading or color shading before shipment of the device. When the setting means 60A is operated, the corresponding circuit section in the correction circuit 60 is controlled so that the gain (amplitude) and phase of the correction signal are adjusted.

The setting means 60A is to generate, in the correction circuit 60, the color shading correction signal required for the LCD panel in the LCD panel section (R) 10 currently in use by the phase control or gain control for the correction signal generated in the correction circuit 60. An example of specific operation by the setting means 60A is similar to that described for the setting means 50A.

The correction circuit 60 generates the correction signal with either positive or negative polarity. To have the correction signal (e) correspond to the polarity reversing by the alternation circuit 13 on the video signal side, the polarity of the correction signal (e) is reversed for every horizontal period by the alternation circuit 61 provided subsequent to the correction circuit 60.

The alternation circuit 61 may have a configuration similar to that of the alternation circuit 13 on the video signal side (Refer to FIGS. 10(*a*) to (*c*)) and may comprise an inverting amplifier, a non-inverting amplifier and a switching means to switch between these amplifiers for every horizontal period.

Figure 14:
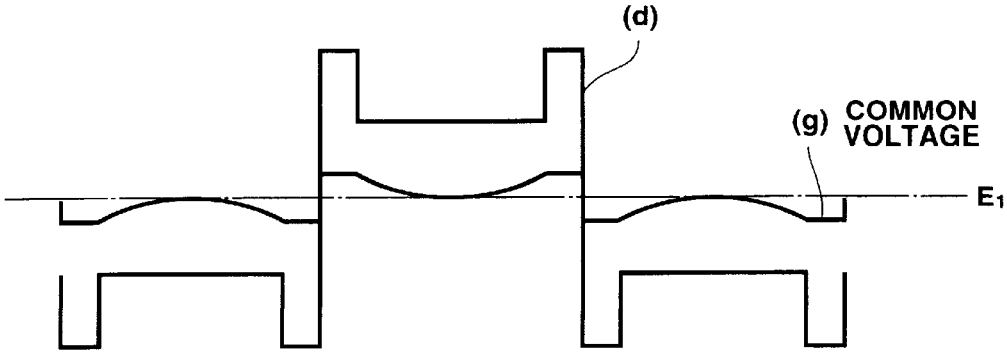
FIG. 14 is a waveform diagram illustrating correction of the luminance shading and color shading in FIG. 13.

The adder 62 adds the correction signal (f) with its polarity reversed to the DC common voltage E1. The common voltage (g) with the correction signal (f) added to is supplied to the pixel common electrode (common terminal) 10*a* of the LCD panel section 10. FIG. 14 shows the relation between the common voltage (g) with the alternating correction signal (f) added to and the alternated video signal (d) supplied to the LCD panel section 10.

The LCD panel section 10 comprises a drive circuit and an LCD panel to form pictures for R. The drive circuit is provided with a sample/hold circuit to which the signal for R with its polarity reversed for every horizontal period from the alternation circuit 13 is input and which samples and holds the signal, a horizontal driver circuit which supplies the sampled/held signal to the signal line (source line) of the pixels on the LCD panel, and a vertical driver circuit which drives the gate line. To the LCD panel section 10, R video signal among the primary color signals RGB is supplied from the alternation circuit 13 for R. At the same time, clock and timing pulses required for display of the output signal from the alternation circuit 13 for R are supplied from the timing circuit 40.

The timing circuit 40 generates the alternating pulse fH for the alternation circuit 13 and the alternation circuit 61 and the clock and timing pulses to drive the LCD panel section 10 from the horizontal and vertical sync signals (HD and VD) input from the input terminal 41. It also generates the timing signal for timing adjustment of the correction signal generated by the correction circuit 60 for the picture period of the video signal.

Then, referring to FIGS. 15(*a*) to (*h*), the operation of the device with the configuration above (FIG. 13) is described below.

FIG. 15(*a*) shows the input video signal at the input terminal 11, FIG. 15(*b*) shows two types of video signals having positive and negative polarities generated by the inverting amplifier Q1 and the non-inverting amplifier Q2 in the alternation circuit 13, FIG. 15(*c*) shows the alternating pulse fH for every horizontal period from the timing circuit 40, FIG. 15(*d*) shows the output from the alternation circuit 13, FIG. 15(*e*) shows the correction signal generated by the correction circuit 60, FIG. 15(*f*) shows the correction signal obtained by reversing the polarity of the correction signal of FIG. 15(*e*) above for every horizontal period by the alternation circuit 61, FIG. 15(*g*) shows the common voltage corrected by adding the correction signal of FIG. 15(*f*) above to the DC voltage E1 at the adder 62, and FIG. 15(*h*) shows the relation between the video signal (d) supplied to the LCD panel section 10 and the common voltage (g).

The input video signal (a) is amplified or otherwise processed for video at the video processing circuit 12. The alternation circuit 13 reverses the polarity of the signal after video processing for every horizontal period using the alternating pulse fH and outputs it as the video signal (d) and supplies it to the LCD panel section 10. The correction circuit 60 generates the correction signal (e) for every horizontal period based on the horizontal and vertical sync signals (HD and VD) from the input terminal 41 and the input video signal (a). The alternation circuit 61 reverses the polarity of the correction signal (e) for every horizontal period. The adder 62 adds the alternated correction signal (f) to the voltage E1 from the DC power supply and supplies the addition signal (g) as the common voltage to the common electrode 10*a* of the LCD panel section 10.

In case of this embodiment, too, as in the explanation about FIGS. 12(*a*) to (*c*), it becomes possible to cancel the luminance shading at a higher precision by generating the correction signal so that it suits to uneven gap pattern or luminance shading pattern. Further, even when the three LCD panels have different luminance shading patterns, the color shading generation can be suppressed by operating the setting means 60A as in the embodiment of FIG. 1 described with referring to FIGS. 2(*a*), (*b*), 3(*a*) and (*b*). This suppression is achieved by adjusting the gain and phase of the correction signal to adapt them to a certain reference (taking the brightest area on a certain LCD panel as the center phase, for example) or by subjecting a certain LCD panel to no-correction processing without providing any correction signal and controlling the gain and phase of the correction signals for the remaining LCD panels so that they have luminance shadings in the pattern similar to that on the above LCD panel after no-correction processing. This results in approximation of the luminance shading patterns on the LCD panels R, G and B. As a result, color shading generation can be suppressed. Alternatively, the luminance shading patterns on the LCD panels R, G and B can be approximated to another pattern serving as the reference common to R, G and B.

Though the color shading is corrected by correction of the luminance shading caused by uneven gap on the LCD panel in this embodiment, it is naturally understood that, with the circuit configuration of FIG. 13 shown for this embodiment, the color shading can be corrected through correction of the luminance shading caused by any factor other than uneven gap such as luminance shading caused by a projection lens or other optical components. Therefore, the color shading among the LCD panels can be corrected by suppressing or correcting the luminance shadings generated on the projection screen due to various causes.

Therefore, according to this embodiment, the same effect as the embodiment of FIG. 1 above can be achieved.

Though a color shading correction device containing a LCD driving circuit channel for the LCD panel R is described in this embodiment according to the present invention, it is naturally understood that a color shading correction device is incorporated in the configuration of the LCD panels G and B respectively. Thus, it is possible to provide a high performance LCD projector which achieves LCD projection pictures of high definition with suppressing generation of color shading.

As described above, the color shading correcting device according to an embodiment of the present invention suppresses generation of color shading by correction to approximate the luminance shading patterns even when the luminance shading is generated differently for different LCD panels in a three-panel type LCD projector, for example. However, when color pictures are achieved with a single-panel type LCD projector or a single LCD panel by adopting RGB color filters, it is possible to provide a higher quality single-panel type LCD projector without luminance shading and color shading just by correcting the luminance shading on that single LCD panel.

Though a method for driving with reversing the polarity for every horizontal period has been described above for the alternation circuits 13 and 61 in the embodiments of FIGS. 1 and 13, the present invention is not limited to such driving method with reversing the polarity for every horizontal period. It can also apply to a case where a method to reverse the polarity for every vertical period or every pixel (dot) is adopted.

Further, though the luminance shading and color shading caused by uneven thickness of the liquid crystal layer (uneven gap) on LCD panels are corrected in the embodiments above, the present invention can be applied to luminance shadings caused by factors other than uneven gap including, for example, shadings caused by optical components such as a projection lens or a dichroic mirror, those caused by lighting from uneven light sources, those due to uneven polarizing plate. By simultaneously suppressing or correcting the luminance shadings generated on the projection screen because of various factors and by correcting the difference in luminance patterns among the LCD panels, the color shading of color synthesized pictures can be corrected at a high precision.

As described above, according to the present invention, generation of the luminance shading on the LCD panel can be suppressed and, even when the luminance shading is generated differently for different LCD panels, correction with approximation of the luminance shading patterns enables suppression of the color shading. Further, by generation of the correction signal which approximates the luminance shading characteristics of the LCD panels and changes its correction amount in response to the level of the video signal supplied to the LCD panels, correction can be made at a higher precision. Therefore, it is possible to provide a high definition LCD pictures by suppressing the color shading caused by uneven gap, which often occurs on a compact LCD panel used in three-panel type LCD data projector or the like.

The present invention has been described above using a case where the amplitude or phase of the correction signal is controlled by determining the brighter (or darker) area watching the luminance shading characteristics on a whole LCD panel and applying DC control by the setting means 50A. However, the luminance shading can also be corrected using digital processing.

For example, a non-colored image with average brightness (50%) is displayed on a whole projection screen, the image on the projection screen is picked up using a brightness level measuring means (such as a camera) which is not shown in the figure, each of the brightness levels of the picked-up images at a plurality of sampling points (for example, a plurality of sampling points at every predetermined interval set both in the horizontal and vertical directions) is determined, the brighter (or darker) point among the sampling points is decided and stored in the memory. Then, a circuit can be provided so that it recognizes the luminance shading generation pattern on an LCD panel based on the information stored in the memory, generates data for correcting the luminance levels at sampling points where the luminance shading is generated and at the periphery thereof, and generates the correction signal according to the data.

It is naturally understood that the present invention is not limited to the embodiments as described above. It can be variously modified without departing the scope and spirit of the invention.

What is claimed is:

1. A color shading correction device used in a liquid crystal display device which has a plurality of LCD panels, modulates the color lights coming into each of the LCD panels according to the video signals and synthesizes the modulated color lights, comprising:

a timing circuit to generate the timing signal required for displaying the picture on said plurality of LCD panels;

a plurality of signal processing circuits to input the video signals for modulating the color lights on said plurality of LCD panels, to process each of the video signals so as to supply them as the video signals suitable to each of said LCD panels; and a plurality of correction circuits to add the correction signals to any video signals supplied to said plurality of LCD panels so as to approximate the luminance shading characteristics caused on said plurality of LCD panels, wherein each of said correction circuits includes a correction signal generating circuit to generate said correction signal for correcting the luminance shading which is caused due to the difference in thickness of said LCD panels under the control of said timing circuit, a low-pass filter which removes the high frequency range components from the video signal before the addition of said correction signal and outputs the low frequency range components only, and a circuit to multiply said correction signal and the low frequency range components from said low pass filter to modulate and output said correction signal to be added so that the correction amount is increased when the level of the video signal is high, and the correction amount is decreased when the level of the video signal is low.

2. A color shading correction device according to claim 1, wherein said correction signal generating circuit generates the parabolic correction signal, the level of which changes backwardly to the lapse of time with reference to the vertex of the parabolic wave and the amplitude of the correction signal can be changed in response to the luminance shading on the LCD panel.

3. A color shading correction device according to claim 1, wherein said correction signal generating circuit generates a parabolic correction signal, the level of which changes backwardly to the lapse of time with reference to the vertex of the parabolic wave and the position of said vertex can be changed in response to the luminance shading of the LCD panel.

4. A color shading correction device according to claim 3, wherein said correction signal generating circuit can adjust the phase of the vertex of said correction signal by changing the DC voltage.

5. A color shading correction device according to claim 1, wherein each of said correction circuits is provided for each of said plurality of LCD panels and each of the LCD panels corrects the generating pattern of the luminance shading so as to approximate it to a pattern as a reference for correction in response to the correction signal from its correction circuit.

6. A color shading correction device according to claim 1, wherein each of said correction circuits is provided for each of other LCD panels except for a first LCD panel and corrects the generating pattern of the luminance shading caused on said other LCD panels so as to approximate them to the luminance shading generating pattern on said first LCD panel.

7. A color shading correction device according to claim 1, wherein a plurarity of polarity reverse circuits are further comprised in each of the former stages of said LCD panels to supply video signals with their polarities reversed for every predetermined period to said LCD panels.

8. A color shading correction device used in a liquid crystal display device which has a plurality of LCD panels, modulates the color lights coming into each of the LCD panels according to the video signals and synthesizes the modulated color lights, comprising:

a timing circuit to generate a timing signal required for displaying the picture on said plurality of LCD panels, a plurality of signal processing circuits to input the video signals for modulating the color lights on said plurality of LCD panels, to process each of the video signals so as to supply them as the video signals suitable to each of said LCD panels, a plurality of correction circuits to approximate the luminance shading characteristics caused on said plurality of LCD panels in which each of said correction circuits includes a correction signal generating circuit to generate said correction signal for correcting the luminance shading which is caused due to the difference in thickness of said LCD panels under the control of said timing circuit, a low-pass filter which removes the high frequency range components from the video signal for the LCD panels where luminance shading corrections are performed and outputs the low frequency range components only, and a circuit to multiply said correction signal and the low frequency range components from said low pass filter to modulate and output said correction signal to be added so that the correction amount is increased when the level of the video signal is high, and the correction amount is decreased when the level of the video signal is low; and a plurality of adder circuits to add said correction signals, to which said correction amount is adjusted, to the voltages supplied to the pixel common electrodes on each of said LCD panels where luminance shading corrections are performed.

9. A color shading correction device according to claim 8, wherein said plurarity of correction circuits in which each of said correction circuits includes, when said LCD panels are driven by the video signals with their polarities reversed for every predetermined period, a means to reverse the polarity of a correction signal, to which said correction amount is adjusted, for every predetermined period.

10. A luminance shading correction device for the LCD panel comprising:

an LCD panel, a timing circuit to generate a timing signal required for displaying a picture on said LCD panels, a video signal input terminal, a signal processing circuit to process video signals inputted to said input terminal and to supply them as the video signals suitable to said LCD panels, and a correction circuit to add the correction signal to the video signal supplied to said LCD panel so as to approximate the luminance shading characteristics caused on said LCD panel, said correction circuit including a correction signal generating circuit to generate said correction signal for correcting the luminance shading which is caused due to the difference in thickness of said LCD panels under the control of said timing circuit, a low-pass filter which removes the high frequency range components from the video signal before the addition of said correction signal and outputs the low frequency range components only, and a circuit to multiply said correction signal and the low frequency range components from said low pass filter to modulate and output said correction signal to be added so that the correction amount is increased when the level of the video signal is high, and the correction amount is decreased when the level of the video signal is low.

11. A luminance shading correction device for the LCD panel comprising:

an LCD panel, a timing circuit to generate a timing signal required for displaying a picture on said LCD panel, a video signal input terminal, a signal processing circuit to process video signals inputted to said input terminal so as to supply them as the video signals suitable to said LCD panel; and, a correction circuit including a correction signal generating circuit to generate a correction signal for correcting the luminance shading which is caused due to the difference in thickness of said LCD panels under the control of said timing circuit, a low-pass filter which removes the high frequency range components from the video signal supplied to said LCD panel and outputs the low frequency range components only, and a circuit to multiply said correction signal and the low frequency range components from said low pass filter to modulate and output said correction signal to be added so that the correction amount is increased when the level of the video signal is high, and the correction amount is decreased when the level of the video signal is low; and an adder circuit to add said correction signal, to which said correction amount is adjusted, to the voltages supplied to the pixel common electrode on said LCD panel.

12. A luminance shading correction device for the LCD panel according to claim 10 or 11, wherein said correction circuit comprises:

a first sawtooth wave generating circuit to which the horizontal sync signal is input and from which the sawtooth wave signal having one horizontal period is generated, a first parabolic wave generating circuit to which the sawtooth wave signal from said first sawtooth wave generating circuit is input and from which the parabolic wave signal having one horizontal period is generated, a second sawtooth wave generating circuit to which the vertical sync signal is input and from which the sawtooth wave signal having one vertical period is generated, a second parabolic wave generating circuit to which the sawtooth wave signal from said second sawtooth wave generating circuit is input and from which the parabolic wave signal having one vertical period is generated, a first multiplier which multiplies the parabolic wave signal having one horizontal period from said first parabolic wave generating circuit and the parabolic wave signal having one vertical period from said second parabolic wave generating circuit so as to generate a correction signal for horizontal and vertical directions, a low pass filter to remove the high frequency range components from said input video signals, and a second multiplier which multiplies the correction signal from said first multiplier with the video signal from said low pass filter so as to modulate the amplitude of said correction signal in response to the amplitude level of said video signals.

13. A luminance shading correction device for the LCD panel according to claim 10 wherein, when said LCD panels are driven by the video signals with their polarities reversed for every predetermined period, the correction signal from said correction circuit is added to the video signals before having their polarities reversed.

14. A luminance shading correction device for the LCD panel according claim 11, wherein said correction circuit, when said LCD panels are driven by the video signals with their polarities reversed for every predetermined period, is provided with means to reverse the polarity of said correction signal for every predetermined period.

* * * * *